US010465968B2

(12) United States Patent
Takenaka et al.

(10) Patent No.: US 10,465,968 B2
(45) Date of Patent: Nov. 5, 2019

(54) AIR-CONDITIONING APPARATUS HAVING FIRST AND SECOND DEFROSTING PIPES

(71) Applicant: Mitsubishi Electric Corporation, Tokyo (JP)

(72) Inventors: Naofumi Takenaka, Tokyo (JP); Shinichi Wakamoto, Tokyo (JP); Kazuya Watanabe, Tokyo (JP); Koji Yamashita, Tokyo (JP); Takeshi Hatomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 387 days.

(21) Appl. No.: 14/894,151

(22) PCT Filed: May 31, 2013

(86) PCT No.: PCT/JP2013/065210
§ 371 (c)(1),
(2) Date: Nov. 25, 2015

(87) PCT Pub. No.: WO2014/192140
PCT Pub. Date: Dec. 4, 2014

(65) Prior Publication Data

US 2016/0116202 A1 Apr. 28, 2016

(51) Int. Cl.
*F25D 21/00* (2006.01)
*F25B 13/00* (2006.01)
*F25B 47/02* (2006.01)

(52) U.S. Cl.
CPC ..... *F25D 21/002* (2013.01); *F25B 13/00* (2013.01); *F25B 47/022* (2013.01);
(Continued)

(58) Field of Classification Search
CPC ..... F25D 21/002; F25B 2313/0251; F25B 2313/0253; F25B 47/022; F25B 2313/006;
(Continued)

(56) References Cited

U.S. PATENT DOCUMENTS 4,139,356 A * 2/1979 Hattori ..... F25B 47/022 62/278
4,389,851 A * 6/1983 Chrostowski ..... F25B 13/00 62/155
(Continued)

FOREIGN PATENT DOCUMENTS

CN 1285907 A 2/2001
JP 57-108558 A 7/1982
(Continued)

OTHER PUBLICATIONS

Combined Chinese Office Action and Search Report dated Aug. 16, 2016 in Patent Application No. 201380077052.2 (with partial English translation and English translation of categories of cited documents).
(Continued)

*Primary Examiner* — Nelson J Nieves
(74) *Attorney, Agent, or Firm* — Oblon, McClelland, Maier & Neustadt, L.L.P.

(57) ABSTRACT

An air-conditioning apparatus includes: a compressor allowing refrigerant injection thereto and compress and discharge the refrigerant at a high temperature; an indoor heat exchanger exchanging heat between air and refrigerant; a first flow rate control device adjusting and controlling a flow rate of refrigerant; and a plurality of outdoor heat exchangers being in parallel to exchange heat between outside air and refrigerant, a first defrosting pipe allowing a branched part of the refrigerant discharged from the compressor to pass and flow into the outdoor heat exchanger to be
(Continued)

defrosted; a reducing device adjusting a pressure of refrigerant passing through the first defrosting pipe to a medium pressure; a second defrosting pipe from which the refrigerant having passed through the outdoor heat exchanger to be defrosted is injected into the compressor; and a reducing device adjusting a pressure of refrigerant passing through the second defrosting pipe to an injection pressure.

10 Claims, 16 Drawing Sheets

(52) U.S. Cl.
CPC . *F25B 2313/006* (2013.01); *F25B 2313/0233* (2013.01); *F25B 2313/0253* (2013.01); *F25B 2313/02741* (2013.01); *F25B 2700/2106* (2013.01)

(58) Field of Classification Search
CPC ..... F25B 2347/02; F25B 13/00; F25B 2313/02741; F25B 2700/2106
See application file for complete search history.

(56) References Cited

U.S. PATENT DOCUMENTS 4,519,214 A * 5/1985 Sano ..... F25B 13/00 62/156
4,565,070 A * 1/1986 Raymond ..... F25B 13/00 62/198
4,698,981 A * 10/1987 Kaneko ..... F25B 13/00 62/180
4,833,893 A * 5/1989 Morita ..... F25B 1/10 62/113
4,850,197 A * 7/1989 Taylor ..... F25B 5/00 62/278
4,893,748 A * 1/1990 Balducci ..... B60H 1/00007 165/42
4,914,926 A * 4/1990 Gregory ..... F25B 47/022 62/196.4
4,942,743 A * 7/1990 Gregory ..... F25B 13/00 62/503
4,949,551 A * 8/1990 Gregory ..... F25B 41/04 62/155
5,174,123 A * 12/1992 Erickson ..... F25B 1/047 62/113
5,319,940 A * 6/1994 Yakaski ..... F25B 47/022 62/151
5,794,452 A * 8/1998 Black ..... F25B 41/04 62/278
5,839,292 A * 11/1998 Hwang ..... F25B 41/04 62/152
6,244,057 B1 * 6/2001 Yoshida ..... F25B 13/00 62/151
6,405,559 B1 6/2002 Yoneda
6,883,334 B1 * 4/2005 Shah ..... F25B 41/04 62/156
7,461,515 B2 * 12/2008 Wellman ..... F25B 47/022 137/315.33
2003/0188544 A1 * 10/2003 Yamasaki ..... F25B 1/10 62/238.1
2004/0020230 A1 * 2/2004 Kuwabara ..... F25B 6/04 62/238.6
2004/0134205 A1 * 7/2004 Park ..... F25B 13/00 62/151
2004/0168451 A1 * 9/2004 Bagley ..... F25B 41/04 62/196.4
2005/0279117 A1 * 12/2005 Choi ..... F25B 13/00 62/324.5
2008/0028773 A1 * 2/2008 Lee ..... F25B 13/00 62/80
2008/0041079 A1 * 2/2008 Nishijima ..... F25B 5/00 62/191
2008/0190131 A1 * 8/2008 Giallombardo ..... F24F 1/48 62/324.5
2009/0173091 A1 * 7/2009 Hu ..... F25B 5/02 62/151
2010/0170270 A1 * 7/2010 Jang ..... F25B 13/00 62/81
2011/0067427 A1 * 3/2011 Haller ..... B60H 1/005 62/324.6
2011/0072840 A1 * 3/2011 Itagaki ..... F24D 3/18 62/222
2011/0154840 A1 * 6/2011 Mihara ..... F25B 9/008 62/196.1
2011/0232308 A1 * 9/2011 Morimoto ..... F25B 13/00 62/132
2012/0011866 A1 * 1/2012 Scarcella ..... F25B 1/10 62/79
2013/0098092 A1 4/2013 Wakamoto et al.
2013/0219943 A1 * 8/2013 Song ..... F25B 30/02 62/324.6
2015/0338139 A1 * 11/2015 Xu ..... F25B 13/00 62/324.6

FOREIGN PATENT DOCUMENTS

JP 2004-219060 A 8/2004
JP 2007-271094 A 10/2007
JP 2008-249236 A 10/2008
JP 2009-85484 A 4/2009
JP 2011-52883 A 3/2011
WO 2012/014345 A1 2/2012

OTHER PUBLICATIONS

Extended European Search Report dated Dec. 5, 2016 in Patent Application No. 13885959.0.
Office Action dated Mar. 10, 2017 in Chinese Patent Application No. 201380077052.2 (with English language translation).
International Search Report dated Aug. 27, 2013 in PCT/JP13/065210 Filed May 31, 2013.

* cited by examiner

FIG. 3

| VALVE NUMBER | COOLING | HEATING | | |
|---|---|---|---|---|
| | | NORMAL OPERATION | CONTINUOUS HEATING | |
| | | | 13a: EVAPORATOR 13b: DEFROSTING | 13a: DEFROSTING 13b: EVAPORATOR |
| 12 | OFF | ON | ON | ON |
| 32a, 32b | INDOOR UNIT OUTLET REFRIGERANT SUPERHEATED | INDOOR UNIT OUTLET REFRIGERANT SUBCOOL | INDOOR UNIT OUTLET REFRIGERANT SUBCOOL | INDOOR UNIT OUTLET REFRIGERANT SUBCOOL |
| 15a | FULLY OPEN | FULLY OPEN | FULLY OPEN | DEFROSTING HEAT EXCHANGER PRESSURE |
| 15b | FULLY OPEN | FULLY OPEN | DEFROSTING HEAT EXCHANGER PRESSURE | FULLY OPEN |
| 16a | ON | ON | ON | OFF |
| 16b | ON | ON | OFF | ON |
| 17a | OFF | OFF | OFF | ON |
| 17b | OFF | OFF | ON | OFF |
| 18 | CLOSED | CLOSED | FIXED OPENING DEGREE | FIXED OPENING DEGREE |
| 19a | OFF | OFF | OFF | ON |
| 19b | OFF | OFF | ON | OFF |
| 20 | CLOSED | CLOSED | DISCHARGE TEMPERATURE (DISCHARGE SUPERHEAT) | DISCHARGE TEMPERATURE (DISCHARGE SUPERHEAT) |

FIG. 17

| VALVE NUMBER | COOLING | HEATING | | |
|---|---|---|---|---|
| | | NORMAL OPERATION | CONTINUOUS HEATING | |
| | | | 13a: EVAPORATOR 13b: DEFROSTING | 13a: DEFROSTING 13b: EVAPORATOR |
| 12 | OFF | ON | ON | ON |
| 32a, 32b | INDOOR UNIT OUTLET REFRIGERANT SUPERHEATED | INDOOR UNIT OUTLET REFRIGERANT SUBCOOL | INDOOR UNIT OUTLET REFRIGERANT SUBCOOL | INDOOR UNIT OUTLET REFRIGERANT SUBCOOL |
| 15a | FULLY OPEN | FULLY OPEN | INTERMEDIATE PRESSURE | CLOSED |
| 15b | FULLY OPEN | FULLY OPEN | CLOSED | INTERMEDIATE PRESSURE |
| 15c | FULLY OPEN | FULLY OPEN | DEFROSTING HEAT EXCHANGER PRESSURE | DEFROSTING HEAT EXCHANGER PRESSURE |
| 16a | ON | ON | ON | OFF |
| 16b | ON | ON | OFF | ON |
| 17a | OFF | OFF | OFF | ON |
| 17b | OFF | OFF | ON | OFF |
| 18 | CLOSED | CLOSED | FIXED OPENING DEGREE | FIXED OPENING DEGREE |
| 19a | OFF | OFF | OFF | ON |
| 19b | OFF | OFF | ON | OFF |
| 20 | CLOSED | CLOSED | DISCHARGE TEMPERATURE (DISCHARGE SUPERHEAT) | DISCHARGE TEMPERATURE (DISCHARGE SUPERHEAT) |

AIR-CONDITIONING APPARATUS HAVING FIRST AND SECOND DEFROSTING PIPES

TECHNICAL FIELD

The present invention relates to an air-conditioning apparatus.

BACKGROUND ART

In view of global environmental protection, boiler-type heating appliances for heating by burning fossil fuel have been replaced by heat-pump-type air-conditioning apparatuses using air as heat sources in more and more cases even in cold regions in recent years. The heat-pump-type air-conditioning apparatus can efficiency perform heating because heat is supplied from air in addition to an electrical input to a compressor.

On other hand, in the heat-pump-type air-conditioning apparatus, however, frost is more easily accumulated on an outdoor heat exchanger serving as an evaporator as the temperature of air in, for example, the outside (outdoor-air temperature) decreases. Thus, it is necessary to perform defrosting (frost removal) for melting frost on the outdoor heat exchanger. For such defrosting, an example method is to reverse a refrigerant flow in heating so as to supply refrigerant from a compressor to an outdoor heat exchanger. This method, however, is performed while heating of a room is stopped in some cases, and thus, has the problem of a loss of comfort.

In view of this, to perform heating during defrosting, proposed are methods for heating by dividing outdoor heat exchangers in such a manner that while some of the outdoor heat exchangers are defrosted, the other outdoor heat exchangers operate as evaporators so as to absorb heat from air, for example (e.g., Patent Literature 1, Patent Literature 2, and Patent Literature 3).

For example, in a technique described in Patent Literature 1, an outdoor heat exchanger is divided into two heat exchanger parts. Then, to defrost one of the heat exchanger parts, an electronic expansion valve disposed upstream of this heat exchanger part is closed. In addition, an electromagnetic shut-off valve of a bypass pipe for conveying refrigerant from a discharge pipe of a compressor to an inlet of the heat exchanger part for bypassing is opened so that part of high-temperature refrigerant discharged from the compressor flows directly into the heat exchanger part to be defrosted. When defrosting of one of the heat exchanger parts is completed, defrosting of the other heat exchanger part is performed. In this case, in a heat exchanger part to be defrosted, defrosting is performed in a state in which the pressure of refrigerant in this heat exchanger part is substantially equal to a suction pressure of the compressor (low-pressure defrosting).

In a technique described in Patent Literature 2, a plurality of heat source units and at least one indoor unit are provided, and refrigerant discharged from a compressor is caused to flow directly into a heat source unit side heat exchanger to be defrosted by reversing connection of a four-way valve of only a heat source unit including the heat source side heat exchanger to be defrosted. In this case, in the heat source unit side heat exchanger to be defrosted, defrosting is performed in a state in which the pressure of refrigerant in this heat source unit side heat exchanger is substantially equal to a discharge pressure of the compressor (high-pressure defrosting).

In a technique described in Patent Literature 3, an outdoor heat exchanger is divided into a plurality of outdoor heat exchanger parts in such a manner that part of high-temperature refrigerant discharged from a compressor alternately flows into the outdoor heat exchanger parts so as to alternately defrost the outdoor heat exchanger parts. Thus, heating can be continuously performed without reversing a refrigeration cycle. Refrigerant supplied to an outdoor heat exchanger part to be defrosted is injected from an injection port of the compressor. In this case, in the outdoor heat exchanger part to be defrosted, defrosting is performed in a state in which the pressure of refrigerant in this outdoor heat exchanger part is lower than a discharge pressure of the compressor and higher than a suction pressure of the compressor (a pressure that is slightly higher than 0 degrees C. in terms of saturation temperature) (medium-pressure defrosting).

CITATION LIST

Patent Literature

Patent Literature 1: Japanese Unexamined Patent Application Publication No. 2009-085484 ([0019], FIG. 3)

Patent Literature 2: Japanese Unexamined Patent Application Publication No. 2007-271094 ([0007], FIG. 2)

Patent Literature 3: International Publication No. WO2012/014345 ([0006], FIG. 1)

SUMMARY OF INVENTION

Technical Problem

In the low-pressure defrosting described in Patent Literature 1, a heat exchanger part to be defrosted and a heat exchanger part serving as an evaporator (i.e., a heat exchanger part not to be defrosted) operate in the same pressure range. In the heat exchanger part serving as an evaporator, refrigerant takes heat from outdoor air. Thus, an evaporating temperature of refrigerant needs to be lower than an outdoor-air temperature. To achieve this, in the heat exchanger part to be defrosted, a saturation temperature of refrigerant is lower than or equal to 0 degrees C. in some cases. Accordingly, condensation latent heat of refrigerant cannot be used for melding frost (0 degrees C.), and the efficiency of defrosting is low in some cases.

In the high-pressure defrosting described in Patent Literature 2, subcooling (the degree of subcooling) of refrigerant at an outlet of a heat source side heat exchanger whose defrosting has finished increases. Thus, temperature distribution occurs in a heat source side heat exchanger to be defrosted, and efficient defrosting cannot be performed. In addition, a large degree of subcooling causes an increase in the amount of liquid refrigerant in the heat source side heat exchanger to be defrosted, and thus, it takes time for liquid refrigerant to move in some cases.

In the medium-pressure defrosting described in Patent Literature 3, condensation latent heat is utilized by controlling the saturation temperature of refrigerant in a state (about 0 to 10 degrees C.) slightly higher than zero. This medium-pressure defrosting shows a small temperature variation of the entire outdoor heat exchanger parts as compared to the low-pressure defrosting and the high-pressure defrosting, and thus, defrosting can be efficiently performed. However, the amount of liquid of refrigerant that can be injected into the compressor is limited, and the flow rate of refrigerant that can be supplied to the outdoor heat exchanger part to be defrosted is limited. In addition, the pressure of the outdoor heat exchanger part to be defrosted might be affected by an injection pressure of an injection compressor. Thus, defrosting capacity is limited, and the time cannot be shortened.

The present invention has been made to solve problems as described above, and it is therefore an object of the present invention to provide an air-conditioning apparatus that can efficiently perform defrosting.

Solution to Problem

An air-conditioning apparatus according to the present invention includes: a compressor configured to allow refrigerant to be injected into a portion located intermediate of a compression stroke, suck refrigerant having a low pressure, compress the refrigerant, and discharge refrigerant having a high temperature; an indoor heat exchanger configured to exchange heat between air to be conditioned and the refrigerant; a first flow rate control device configured to adjust and control a flow rate of the refrigerant passing through the indoor heat exchanger; a plurality of outdoor heat exchangers connected in parallel and configured to exchange heat between outdoor air and the refrigerant, the compressor, the indoor heat exchanger, the first flow rate control device, and the plurality of outdoor heat exchangers being connected by pipes and forming a main refrigerant circuit in which the refrigerant circulates; a first defrosting pipe through which a branched part of the refrigerant discharged from the compressor passes and flows into at least one of the outdoor heat exchangers to be defrosted; a first pressure adjustment device configured to adjust the refrigerant passing through the first defrosting pipe to a medium pressure higher than the low pressure and lower than the high pressure; a second defrosting pipe from which the refrigerant that has passed through the at least one of the outdoor heat exchangers to be defrosted is injected into the compressor; and a second pressure adjustment device configured to adjust a pressure of refrigerant passing through the second defrosting pipe to an injection pressure.

Advantageous Effects of Invention

The present invention provides an air-conditioning apparatus in which defrosting is performed by causing refrigerant to flow into an outdoor heat exchanger to be defrosted through a path different from a main refrigerant circuit under a pressure adjusted by a first pressure adjustment device and a second pressure adjustment device. Thus, the defrosting can be efficiently performed without stopping heating of an indoor unit, for example.

BRIEF DESCRIPTION OF DRAWINGS

FIG. 3 is a table showing states of ON/OFF (opening/closing) or opening degree adjustment of devices having valves in the air-conditioning apparatus 100 according to Embodiment 1 of the present invention.

FIG. 17 is a table showing states of ON/OFF (opening/closing) or opening degree adjustment of devices having valves in the air-conditioning apparatus 100 according to Embodiment 2 of the present invention.

DESCRIPTION OF EMBODIMENTS

Figure 1:
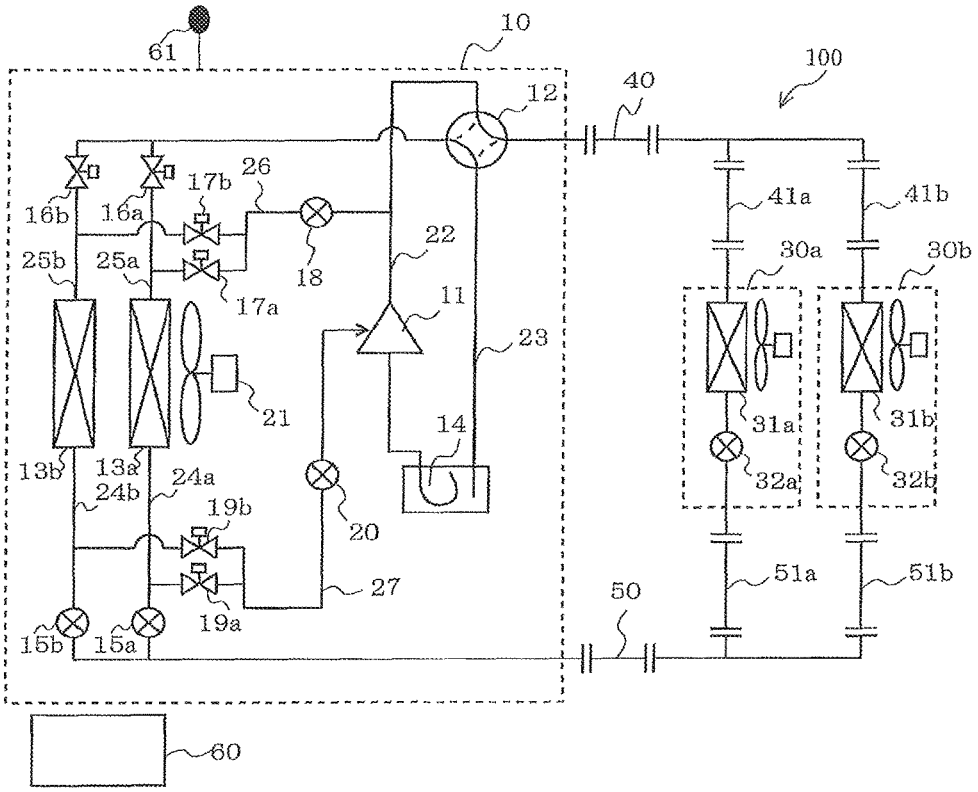
FIG. 1 illustrates a configuration of an air-conditioning apparatus 100 according to Embodiment 1 of the present invention.

Embodiments of the present invention will be described with reference to the drawings. In the drawings, the same reference characters designate the same or like components, and the same holds for the entire description of the specification. The configurations of components in the following description are merely examples, and the present invention is not limited to these examples. In particular, combinations of components are not limited to those in the embodiments, and components in one embodiment are applicable to another embodiment. Similar devices distinguished by suffixes, for example, may be collectively referred to without the suffixes when these devices do not need to be individually distinguished or specified. The levels of, for example, temperature and pressure are not determined based on specific absolute values, and are determined relative to the states, operation, and other factors in, for example, a system or a device.

Embodiment 1

FIG. 1 illustrates a configuration of an air-conditioning apparatus 100 according to Embodiment 1 of the present invention. The air-conditioning apparatus 100 of this embodiment includes an outdoor unit 10 and a plurality of indoor units 30*a* and 30*b*. The outdoor unit 10 is connected to the indoor units 30*a* and 30*b* by first extension pipes 40, 41*a*, and 41*b* and second extension pipes 50, 51*a*, and 51*b*, thereby forming a refrigerant circuit. In the refrigerant circuit, the indoor unit 30*a* and the indoor unit 30*b* are connected in parallel with the outdoor unit 10. The air-conditioning apparatus 100 includes a control device 60. The control device 60 performs a process based on, for example, a temperature and a pressure detected by detectors (sensors) provided in the air-conditioning apparatus 100, controls devices in the air-conditioning apparatus 100, and controls cooling and heating of a space to be air-conditioned performed at least one of the indoor unit 30*a* or 30*b*. An outdoor-air temperature sensor 61 is a temperature detector for detecting an outdoor temperature. The air-conditioning apparatus according to this embodiment also includes a pressure sensor and a temperature sensor for detecting a pressure and a temperature of refrigerant discharged and sucked from/into the compressor 11. The air-conditioning apparatus also includes, for example, temperature sensors for detecting, for example, temperatures of refrigerant in outdoor heat exchangers 13 and an indoor heat exchanger 31.

Examples of refrigerant circulating in a refrigerant circuit include fluorocarbon refrigerant and HFO refrigerant. Examples of the fluorocarbon refrigerant include a HFC-based refrigerant such as R32 refrigerant, R125, and R134a, and a refrigerant mixture of these refrigerants, such as R410A, R407c, or R404A. Examples of the HFO refrigerant include HFO-1234yf, HFO-1234ze (E), and HFO-1234ze (Z). Examples of other refrigerants include refrigerants for use in vapor compression heat pumps, such as $CO_2$ refrigerant, HC refrigerant (e.g., propane or isobutane refrigerant), ammonia refrigerant, and refrigerant mixture of R32 and HFO-1234yf.

In the air-conditioning apparatus 100 of this embodiment 1, the two indoor units 30*a* and 30*b* are connected to one outdoor unit 10. Alternatively, only one indoor unit 30 may be provided, or three such indoor units may be connected in parallel. Two or more outdoor units 10 may also be connected to in parallel. In addition, a refrigerant circuit configuration may be employed in such a manner that cooling and heating can be simultaneously performed, that is, each of the indoor units 30 is individually allowed to select cooling or heating by, for example, providing a switching valve in the indoor unit 30.

A configuration of the refrigerant circuit in the air-conditioning apparatus 100 will now be described. The refrigerant circuit of the air-conditioning apparatus 100 includes a refrigerant circuit serving as a main circuit (main refrigerant circuit) formed by connecting the compressor 11, a cooling/heating switching device 12, and an outdoor heat exchanger 13 of the outdoor unit 10 to an indoor heat exchanger 31 and a first flow rate control device 32 that is freely opened and closed of the indoor unit 30 by pipes. In this embodiment, although an accumulator 14 is connected to the main refrigerant circuit, the accumulator 14 is not a necessary component, and thus, may not be connected to the main refrigerant circuit.

The compressor 11 sucks refrigerant, compresses the refrigerant into a high-temperature high-pressure gaseous state, and discharges the resulting refrigerant. The compressor 11 of this embodiment includes a port that allows injection (refrigerant introduction) into a portion located intermediate of a compression stroke in a compression chamber (not shown). For example, a discharge temperature can be reduced, for example, by injecting liquid refrigerant under a predetermined pressure (injection pressure). The compressor 11 is a compressor of a type that can control the rotation speed (driving frequency) by using, for example, an inverter circuit so as to change the discharge amount (discharge capacity) of refrigerant. The cooling/heating switching device 12 is connected to a point between a discharge pipe 22 and a suction pipe 23 of the compressor 11 and switches the direction of refrigerant flow. The cooling/heating switching device 12 is constituted by, for example, a four-way valve. Based on an instruction of the control device 60, the cooling/heating switching device 12 switches between a pipe connection state indicated by continuous lines in FIG. 1 in a heating operation and a pipe connection state indicated by broken lines in FIG. 1 in a cooling operation.

Figure 2:
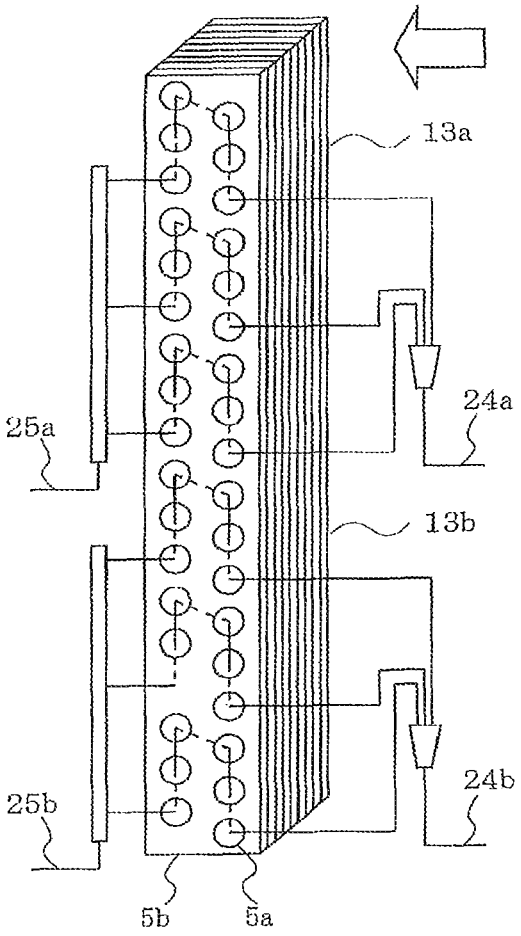
FIG. 2 illustrates an example configuration of an outdoor heat exchanger of the air-conditioning apparatus 100 according to Embodiment 1 of the present invention.

FIG. 2 illustrates an example configuration of the outdoor heat exchanger 13 of the air-conditioning apparatus 100 according to Embodiment 1 of the present invention. As illustrated in FIG. 2, the outdoor heat exchanger of this embodiment is a fin-and-tube heat exchanger including a plurality of heat transfer tubes 5*a* and a plurality of fins 5*b*, for example. The heat transfer tubes 5*a* allow refrigerant to pass therethrough and are arranged in a plurality of levels extending perpendicularly to direction of passage of air and a plurality of columns extending in parallel with the direction of passage of air. The fins 5*b* are spaced from one another in such a manner that air passes therethrough in the direction of passage of air.

As illustrated in FIG. 2, for the outdoor heat exchanger 13 of this embodiment, one outdoor heat exchanger includes a plurality of independent channels. This outdoor heat exchanger is divided into a plurality of outdoor heat exchangers 13 by inlets and outlets of the channels in parallel with the refrigerant main circuit. In this example, the outdoor heat exchanger is divided into two outdoor heat exchangers 13*a* and 13*b*. The outdoor heat exchanger is not necessarily divided into two. The outdoor heat exchanger may be divided into left and right exchangers (i.e., horizontal division). In this case, however, the inlet and outlet of refrigerant of each of the outdoor heat exchangers 13*a* and 13*b* are separated at the left and right ends of the outdoor unit 10, which complicates connection of pipes. In view of this, the outdoor heat exchanger is preferably divided into upper and lower exchangers (i.e., vertical division) as illustrated in FIG. 2. In addition, as illustrated in FIG. 2, the fins 5*b* are common to the outdoor heat exchangers 13*a* and 13*b* of this embodiment, that is, are not divided.

Thus, in a heating defrosting operation described later, high-temperature refrigerant flows in the heat transfer tubes 5*a* and heats the fins 5*b* in order to melt frost in one of the outdoor heat exchangers 13, whereas refrigerant flowing in the heat transfer tubes 5*a* takes heat through the fins 5*b* in the other outdoor heat exchanger 13. In view of this, to prevent leakage of heat between the outdoor heat exchangers 13, the fins 5*b* are divided into parts individually corresponding to the outdoor heat exchangers 13.

An outdoor fan 21 causes air in the outside (outdoor air) to pass through the outdoor heat exchangers 13*a* and 13*b* so as to promote heat exchange with refrigerant. In FIG. 1, one outdoor fan 21 is provided for the outdoor heat exchangers 13*a* and 13*b*, but may be provided for each of the outdoor heat exchangers 13*a* and 13*b*.

First connection pipes 24*a* and 24*b* are connected to the outdoor heat exchangers 13*a* and 13*b*, respectively. In this embodiment, the connection pipes 24*a* and 24*b* are connected to the refrigerant inflow ends of the outdoor heat exchangers 13*a* and 13*b* in a heating operation. Second flow rate control devices 15*a* and 15*b* are provided in channels of the first connection pipes 24*a* and 24*b*, respectively. The second flow rate control devices 15*a* and 15*b* are constituted by electronically controlled expansion valves. Based on an instruction from the control device 60, the second flow rate control devices 15*a* and 15*b* change the opening degrees thereof so as to control a flow rate of refrigerant by pressure adjustment. The second flow rate control devices 15*a* and 15*b* of Embodiment 1 correspond to a "third pressure adjustment device" of the present invention.

Second connection pipes 25*a* and 25*b* are connected to the outdoor heat exchangers 13*a* and 13*b*, respectively, at the opposite ends to the first connection pipes 24*a* and 24*b*. In this embodiment, the second connection pipes 25*a* and 25*b* are connected to refrigerant outflow ends of the outdoor heat exchangers 13*a* and 13*b* in the heating operation. First solenoid valves 16*a* and 16*b* are provided in channels of the second connection pipes 25*a* and 25*b*, respectively. Based on an instruction from the control device 60, each of the first solenoid valves 16*a* and 16*b* switches, by opening and closing the valve, as to whether or not refrigerant flows into/from the outdoor heat exchangers 13*a* and 13*b* from the main refrigerant circuit.

The air-conditioning apparatus 100 of this embodiment further includes a first defrosting pipe 26 as a channel different from the refrigerant main circuit. The first defrosting pipe 26 has one end connected to the discharge pipe 22 and the other end branched into parts respectively connected to the second connection pipes 25*a* and 25*b*. The first defrosting pipe 26 supplies part of high-temperature high-pressure refrigerant discharged from the compressor 11 to at least one of the outdoor heat exchangers 13*a* and 13*b* for defrosting. The first defrosting pipe 26 includes a reducing device 18. Based on an instruction from the control device 60, the reducing device 18 reduces the pressure of part of the high-temperature high-pressure refrigerant discharged from the compressor 11 to a medium pressure. The medium pressure herein is a pressure lower than a high pressure (discharge pressure) and higher than an injection pressure and a low pressure (suction pressure). Thus, in defrosting, the refrigerant whose pressure has been reduced to the medium pressure is supplied to the outdoor heat exchangers 13*a* and 13*b*. Second solenoid valves 17*a* and 17*b* are provided in branched parts of the first defrosting pipe 26. Each of the second solenoid valves 17*a* and 17*b* switches as to whether or not refrigerant flows into the second connection pipes 25*a* and 25*b* from the discharge pipe 22 through the first defrosting pipe 26. The reducing device 18 corresponds to a "first pressure adjustment device" of the present invention.

The first solenoid valves 16*a* and 16*b* and the second solenoid valves 17*a* and 17*b* only need to switch channels between the main refrigerant circuit and the first defrosting pipe 26. Thus, the first solenoid valves 16*a* and 16*b* and the second solenoid valves 17*a* and 17*b* may be constituted by four-way valves, three-way valves, or two way valves, for example. For example, each of the first solenoid valves 16*a* and 16*b* reverses the pressures at the front and rear thereof because refrigerant therein flows in different directions in different operations. A typical solenoid valve cannot be used in some cases when the front and rear pressures are reversed. In view of this, a four-way valve whose high-pressure sides are connected to the discharge pipe 22 and low-pressure sides are connected to the suction pipe 23 can be employed so as to have the same function as the first solenoid valves 16*a* and 16*b*. Since the sides of the second solenoid valves 17*a* and 17*b* connected to the first defrosting pipe 26 at the discharge pipe 22 are always at high pressures, and thus, may be two way valves each of which switches in two directions.

The reducing device 18 may be constituted by a capillary tube as long as a necessary defrosting capacity (the flow rate of refrigerant to flow into the first defrosting pipe 26 for defrosting) is determined. The sizes of the second solenoid valves 17*a* and 17*b* may be reduced without using the reducing device 18 so that the pressures thereof are reduced to a medium pressure at a predetermined defrosting flow rate. A flow rate control device may be provided instead of the second solenoid valves 17*a* and 17*b*, without using the reducing device 18. In such cases, the second solenoid valves 17*a* and 17*b* or the flow rate control device, for example, corresponds to a "first pressure adjustment device" of the present invention.

The second defrosting pipe 27 also serve as a channel different from the refrigerant main circuit. The second defrosting pipe 27 has one end connected to a port at an injection portion of the compressor 11 and the other end branched into parts respectively connected to the first connection pipes 24*a* and 24*b*. The second defrosting pipe 27 includes a reducing device 20 and third solenoid valves 19*a* and 19*b*. In a heating defrosting operation described later, the reducing device 20 reduces the pressure of part of medium-temperature medium-pressure refrigerant that has flowed from the outdoor heat exchanger 13*a* or 13*b* to an injection pressure. The refrigerant whose pressure has been reduced is injected into the compressor 11. Each of the third solenoid valves 19*a* and 19*b* is provided at a branch point in the second defrosting pipe 27, and switches as to whether or not refrigerant flows from the first connection pipes 24*a* and 24*b* to the second defrosting pipe 27. The reducing device 20 corresponds to a "second pressure adjustment device" of the present invention.

Operational behaviors of operations performed by the air-conditioning apparatus 100 of this embodiment will now be described. The operations performed by the air-conditioning apparatus 100 include two operations: a cooling operation and a heating operation. The heating operation includes a heating normal operation and a heating defrosting operation (also referred to as a continuous heating operation). In the heating normal operation, both the outdoor heat exchangers 13*a* and 13*b* constituting the outdoor heat exchangers 13 operate as evaporators. The heating defrosting operation is an operation in which the outdoor heat exchanger 13*a* and the outdoor heat exchanger 13*b* are alternately defrosted while a heating operation continues. Specifically, a heating operation is performed with one of the outdoor heat exchangers 13 operating as an evaporator, whereas the other outdoor heat exchanger 13 is defrosted. When the defrosting of the latter outdoor heat exchanger 13 is finished, this outdoor heat exchanger then operates as an evaporator to perform a heating operation, whereas the former outdoor heat exchanger 13 is defrosted.

FIG. 3 is a table showing states of ON/OFF (opening/closing) or opening degree adjustment of devices (valves) having valves in operations of the air-conditioning apparatus 100 according to Embodiment 1 of the present invention. In FIG. 3, with regard to the cooling/heating switching device 12, ON represents a connection state indicated by the continuous lines in FIG. 1, whereas OFF represents a connection state indicated by the broken lines in FIG. 1. With regard to each of the solenoid valves 16*a*, 16*b*, 17*a*, 17*b*, 19*a*, and 19*b*, ON represents a state in which the valve is open so that refrigerant flows, whereas OFF represents a state in which the valve is closed so that refrigerant does not flow.

[Cooling Operation]

Figure 4:
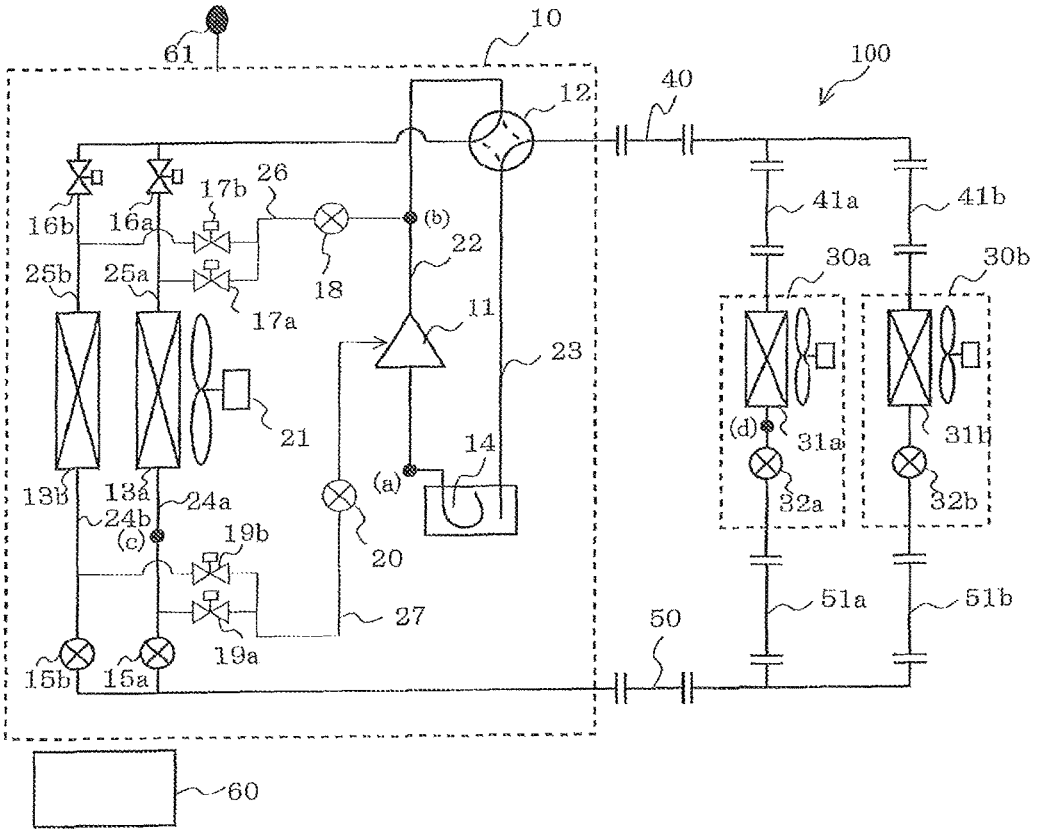
FIG. 4 is a view showing a flow of refrigerant in a cooling operation of the air-conditioning apparatus 100 according to Embodiment 1 of the present invention.
Figure 5:
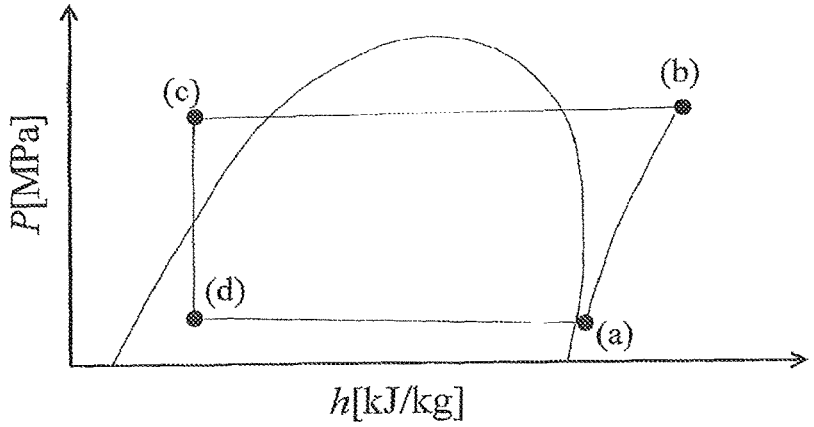
FIG. 5 is a P-h diagram in the cooling operation of the air-conditioning apparatus 100 according to Embodiment 1 of the present invention.

FIG. 4 is a view showing a flow of refrigerant in a cooling operation of the air-conditioning apparatus 100 according to Embodiment 1 of the present invention. In FIG. 4, bold lines represent sections where refrigerant flows in the cooling operation, and thin lines represent sections where refrigerant does not flow. FIG. 5 is a P-h diagram in the cooling operation of the air-conditioning apparatus 100 according to Embodiment 1 of the present invention. In FIG. 5, point (a) to point (d) represent the states of refrigerant at points denoted by the same characters in FIG. 4.

When an operation starts, the compressor 11 sucks low-temperature low-pressure gas refrigerant through the suction pipe 23, compresses the refrigerant, and discharges high-temperature high-pressure gas refrigerant. In this refrigerant compression process of the compressor 11, refrigerant is compressed with heat to a degree corresponding to an adiabatic efficiency of the compressor 11, as compared to adiabatic compression represented by an isentrope, as indicated by a curve from point (a) to point (b) in FIG. 5. High-temperature high-pressure gas refrigerant discharged from the compressor 11 passes through the cooling/heating switching device 12 to be branched into two refrigerant parts. One of the two refrigerant parts passes through the first solenoid valve 16*a* and flows into the outdoor heat exchanger 13*a* from the second connection pipe 25*a*. The other passes through the first solenoid valve 16*b* and flows into the outdoor heat exchanger 13*b* from the second connection pipe 25*b*.

The refrigerant that has flowed into the outdoor heat exchangers 13*a* and 13*b* is cooled while heating outdoor air through heat exchange with the outdoor air and becomes a medium-temperature high-pressure liquid refrigerant. In consideration of a pressure loss in the outdoor heat exchangers 13, a refrigerant change in the outdoor heat exchangers 13*a* and 13*b* is represented a slightly tilted approximately horizontal line indicated by a line from point (b) to point (c) in FIG. 5. Here, heat exchange is performed in both of the outdoor heat exchangers 13*a* and 13*b*. Alternatively, in a case where the operation capacities of the indoor units 30*a* and 30*b* are small, for example, the first solenoid valve 16*b* may be closed so that no refrigerant flows into the outdoor heat exchanger 13*b*. By preventing refrigerant from flowing, the heat transfer area of the outdoor heat exchangers 13 decreases consequently, thereby performing an operation in stable cycles.

The medium-temperature high-pressure liquid refrigerants that have flowed out from the outdoor heat exchangers 13*a* and 13*b* respectively flow into the first connection pipes 24*a* and 24*b*, pass through the second flow rate control devices 15*a* and 15*b* in fully opened states, and then are combined. The combined refrigerant flows out of the outdoor unit 10. Then, the refrigerant passes through the second extension pipes 50, 51*a*, and 51*b* and flows into the indoor units 30*a* and 30*b*. The refrigerant then passes through first flow rate control devices 32*a* and 32*b*. While passing through the first flow rate control devices 32*a* and 32*b*, the refrigerant is expanded and has its pressure reduced and becomes refrigerant in a low-temperature low-pressure two-phase gas-liquid state. The change of refrigerant in the first flow rate control devices 32*a* and 32*b* is performed under a constant enthalpy. The refrigerant change at this time is represented by a vertical line from point (c) to point (d) in FIG. 5.

The refrigerant in the low-temperature low-pressure two-phase gas-liquid state that has flowed out of the first flow rate control devices 32*a* and 32*b* flows into indoor heat exchangers 31*a* and 31*b*. The refrigerant that has flowed into the indoor heat exchangers 31*a* and 31*b* is heated while cooling indoor air through heat exchange with the indoor air, and becomes low-temperature low-pressure gas refrigerant. Here, the control device 60 controls the opening degrees of the first flow rate control devices 32*a* and 32*b* in such a manner that the superheat (degree of superheat) of the low-temperature low-pressure gas refrigerant from the indoor heat exchangers 31*a* and 31*b* is about 2 K to 5 K. In consideration of a pressure loss, the change of refrigerant in the indoor heat exchangers 31*a* and 31*b* is represented by a slightly tilted approximately horizontal line indicated by a line from point (e) to point (a) in FIG. 5.

The low-temperature low-pressure gas refrigerant that has flowed out of the indoor heat exchangers 31*a* and 31*b* flows out of the indoor units 30*a* and 30*b*. The refrigerant then passes through the first extension pipes 41*a*, 41*b*, and 40 and flows into the outdoor unit 10. Thereafter, the refrigerant passes through the cooling/heating switching device 12 and the accumulator 14 and is sucked into the compressor 11 through the suction pipe 23.

[Heating Normal Operation]

Figure 6:
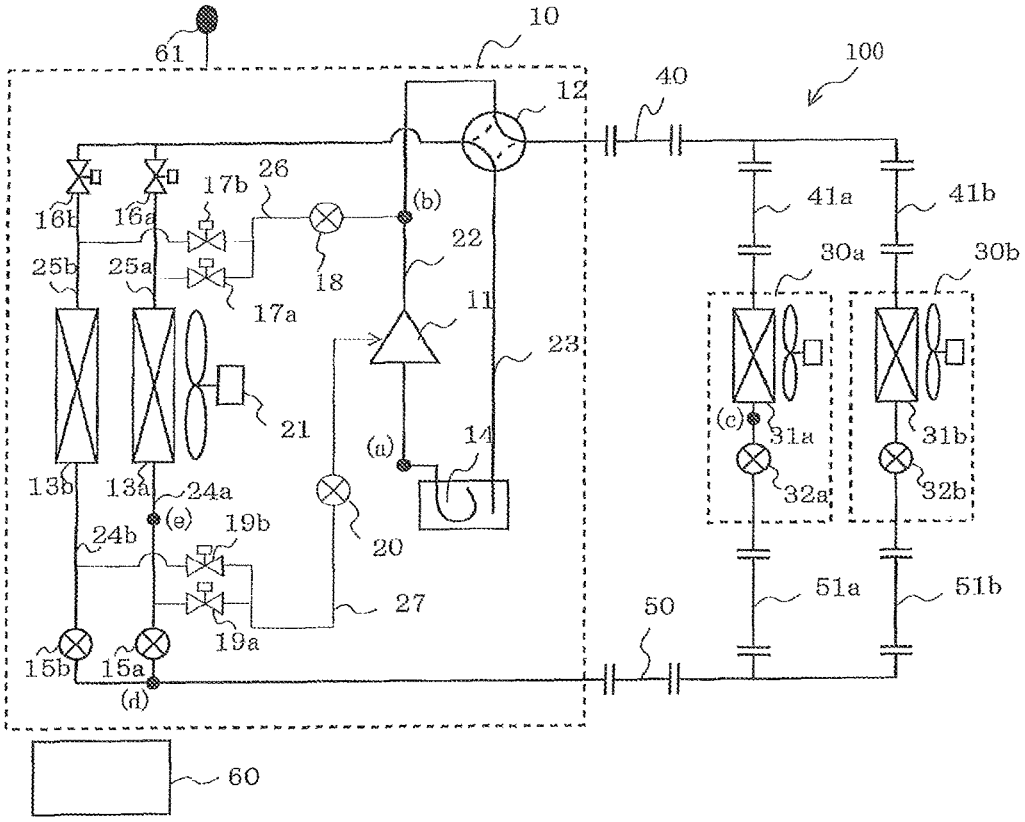
FIG. 6 is a view showing a flow of refrigerant in a heating normal operation of the air-conditioning apparatus 100 according to Embodiment 1 of the present invention.
Figure 7:
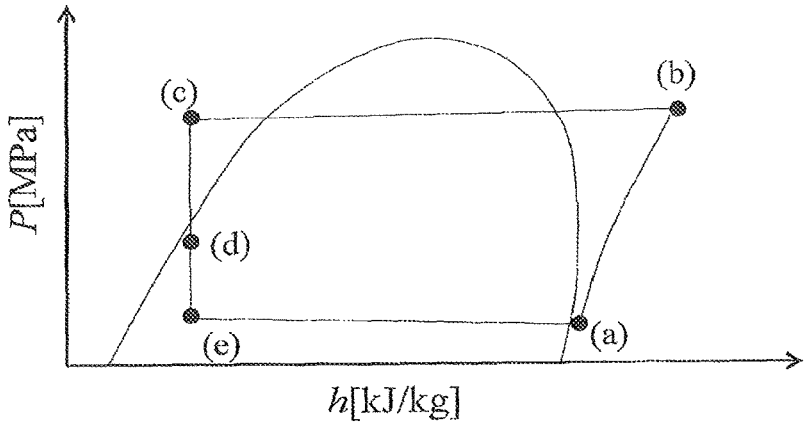
FIG. 7 is a P-h diagram in the heating normal operation of the air-conditioning apparatus 100 according to Embodiment 1 of the present invention.

FIG. 6 is a view showing a flow of refrigerant in a heating normal operation of the air-conditioning apparatus 100 according to Embodiment 1 of the present invention. In FIG. 6, bold lines represent sections where refrigerant flows in the heating normal operation, and thin lines represent sections where refrigerant does not flow. FIG. 7 is a P-h diagram in the heating normal operation of the air-conditioning apparatus 100 according to Embodiment 1 of the present invention. In FIG. 7, point (a) to point (e) represent the states of refrigerant at points denoted by the same characters in FIG. 6.

When an operation starts, the compressor 11 sucks low-temperature low-pressure gas refrigerant through the suction pipe 23, compresses the refrigerant, and discharges high-temperature high-pressure gas refrigerant. The refrigerant compression process of the compressor 11 is represented by a curve from point (a) to point (b) in FIG. 7.

The high-temperature high-pressure gas refrigerant discharged from the compressor 11 passes through the cooling/heating switching device 12 and then flows out of the outdoor unit 10. The high-temperature high-pressure gas refrigerant that has flowed out of the outdoor unit 10 flows into the indoor units 30*a* and 30*b* through the first extension pipes 40, 41*a*, and 41*b*. The refrigerant then flows into the indoor heat exchangers 31*a* and 31*b*. The refrigerant that has flowed into the indoor heat exchangers 31*a* and 31*b* is cooled while heating indoor air through heat exchange with the indoor air, and becomes medium-temperature high-pressure liquid refrigerant. The change of refrigerant in the indoor heat exchangers 31*a* and 31*b* is represented by a slightly tilted approximately horizontal line from point (b) to point (c) in FIG. 7.

The medium-temperature high-pressure liquid refrigerant that has flowed out of the indoor heat exchangers 31*a* and 31*b* passes through the first flow rate control devices 32*a* and 32*b*. While passing through the first flow rate control devices 32*a* and 32*b*, the refrigerant is expanded and has its pressure reduced and becomes refrigerant in a medium-pressure two-phase gas-liquid state. The change of refrigerant at this time is represented by a vertical line from point (c) to point (d) in FIG. 7. The control device 60 controls the opening degrees of the first flow rate control devices 32*a* and 32*b* in such a manner that the subcooling (degree of subcooling) of the medium-temperature high-pressure liquid refrigerant is about 5K to 20K. The refrigerant in the medium-pressure two-phase gas-liquid state that has flowed out of the first flow rate control devices 32*a* and 32*b* flows out of the indoor units 30*a* and 30*b*.

The refrigerant that has flowed out of the indoor units 30*a* and 30*b* flows into the outdoor unit 10 through the second extension pipes 51*a*, 51*b*, and 50. The refrigerant that has flowed into the outdoor unit 10 flows into the first connection pipes 24*a* and 24*b*. The refrigerant that has flowed into the first connection pipes 24*a* and 24*b* passes through the second flow rate control devices 15*a* and 15*b*. While passing through the second flow rate control devices 15*a* and 15*b*, the refrigerant is expanded and has its pressure reduced and becomes a low-pressure two-phase gas-liquid state. The change of refrigerant at this time is represented by a curve from point (d) to point (e) in FIG. 7. The control device 60 controls the opening degrees of the second flow rate control devices 15*a* and 15*b* in such a manner that the opening degrees are fixed at a constant opening degree (e.g., in a fully open state) or an intermediate-pressure saturation temperature of the second extension pipe 50, for example, is about 0 to 20 degrees C.

The refrigerant that has passed through the second flow rate control devices 15*a* and 15*b* flows into the outdoor heat exchangers 13*a* and 13*b*. The refrigerant that has flowed into the outdoor heat exchangers 13*a* and 13*b* is heated while cooling outdoor air through heat exchange with the outdoor air and becomes low-temperature low-pressure gas refrigerant. The change of refrigerant in the outdoor heat exchangers 13*a* and 13*b* is represented by a slightly tilted approximately horizontal line from point (e) to point (a) in FIG. 7.

The low-temperature low-pressure gas refrigerants that have flowed out of the outdoor heat exchangers 13*a* and 13*b* respectively flow into the second connection pipes 25*a* and 25*b*, pass through the first solenoid valves 16*a* and 16*b*, and then are combined. The combined refrigerant passes through the cooling/heating switching device 12 and the accumulator 14 and is sucked into the compressor 11 through the suction pipe 23.

[Heating Defrosting Operation (Continuous Heating Operation)]

A heating defrosting operation is performed when the control device 60 determines that frost is accumulated on the outdoor heat exchangers 13 in the heating normal operation. A plurality of methods can be employed to determine the presence of frost accumulation on the outdoor heat exchangers 13. As one example, frost is determined to be accumulated if a saturation temperature obtained by conversion from a suction pressure of the compressor 11 is determined to decrease significantly from a predetermined outdoor-air temperature. As another example, frost is determined to be accumulated if a temperature difference between an outdoor-air temperature and an evaporating temperature in the outdoor heat exchangers 13 is determined to be greater than or equal to a predetermined difference for a predetermined period or longer.

In the configuration of the air-conditioning apparatus 100 according to Embodiment 1, while the outdoor heat exchanger 13*b* is being defrosted in the heating defrosting operation, the outdoor heat exchanger 13*a* serves as an evaporator so as to continue heating. In contrast, while the outdoor heat exchanger 13*a* is being defrosted, the outdoor heat exchanger 13*b* serves as an evaporator so as to continue heating. Between the case of defrosting the outdoor heat exchanger 13*a* and the case of defrosting the outdoor heat exchanger 13*b*, the open/close states of the first solenoid valve 16, the second solenoid valve 17, and the third solenoid valve 19 are reversed and the flow of refrigerant in the outdoor heat exchangers 13 are different, but the other part of the operation is the same. Thus, the following description is directed to the case where the outdoor heat exchanger 13*b* is defrosted and the outdoor heat exchanger 13*a* serves as an evaporator so as to continue heating in the heating defrosting operation. The same holds for the subsequent embodiments.

Figure 8:
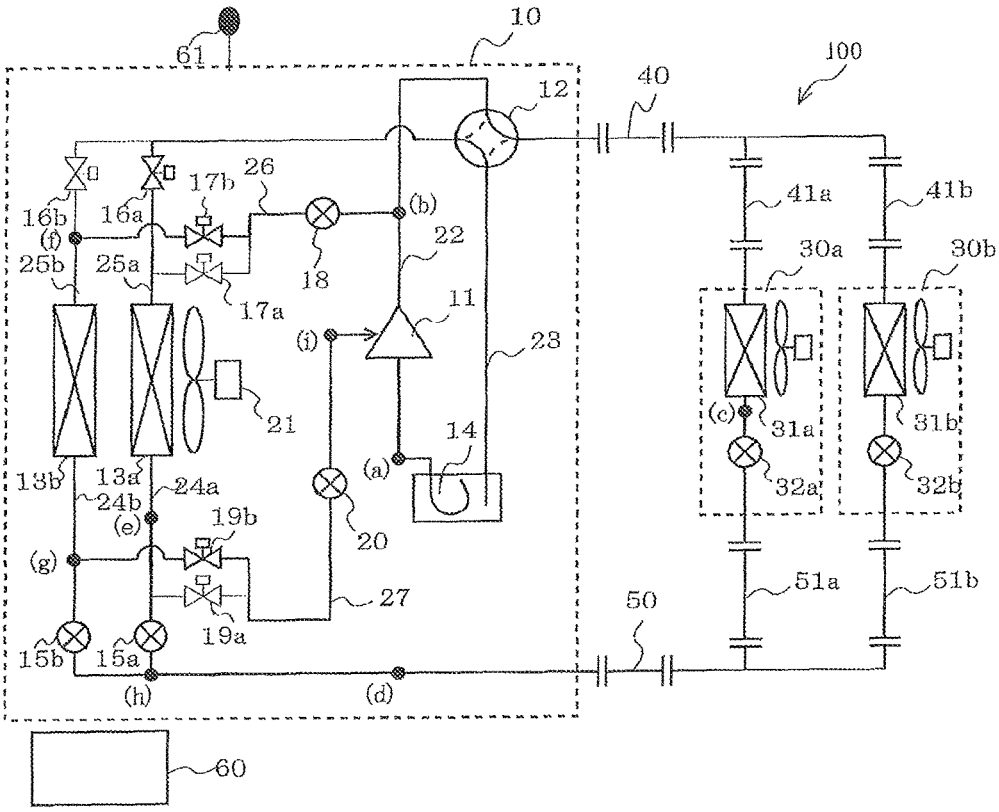
FIG. 8 is a view showing a flow of refrigerant in a heating defrosting operation of the air-conditioning apparatus 100 according to Embodiment 1 of the present invention.
Figure 9:
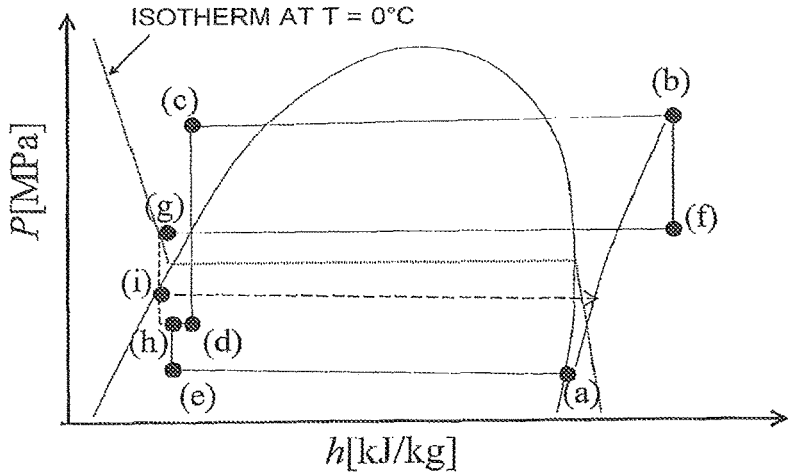
FIG. 9 is a P-h diagram in the heating defrosting operation of the air-conditioning apparatus 100 according to Embodiment 1 of the present invention.

FIG. 8 is a view showing a flow of refrigerant in a heating defrosting operation of the air-conditioning apparatus 100 according to Embodiment 1 of the present invention. In FIG. 8, bold lines represent sections where refrigerant flows in defrosting of the outdoor heat exchanger 13*b*, and thin lines represent sections where refrigerant does not flow. FIG. 9 is a P-h diagram in the heating defrosting operation of the air-conditioning apparatus 100 according to Embodiment 1 of the present invention. In FIG. 9, point (a) to point (i) represent the states of refrigerant at points denoted by the same characters in FIG. 8.

The control device 60 determines which one of the outdoor heat exchangers 13 is be defrosted. If it is determined that the outdoor heat exchanger 13*b* is to be defrosted, the first solenoid valve 16*b* corresponding to the outdoor heat exchanger 13*b* is closed. The control device 60 opens the second solenoid valve 17*b* and the third solenoid valve 19*b* and adjusts the reducing device 18 and the reducing device 20 to predetermined opening degrees.

In this manner, a refrigerant path (first refrigerant path) passing through the compressor 11, the reducing device 18, the second solenoid valve 17*b*, the outdoor heat exchanger 13*b*, the second flow rate control device 15*b*, and the second flow rate control device 15*a* in this order is formed. A refrigerant path (medium-pressure defrosting circuit, second refrigerant path) serving as an injection part and passing through the compressor 11, the reducing device 18, the second solenoid valve 17*b*, the outdoor heat exchanger 13*b*, the third solenoid valve 19*b*, the reducing device 20, and the compressor 11 in this order is also formed. Then, a heating defrosting operation starts.

When the heating defrosting operation starts, part of high-temperature high-pressure gas refrigerant discharged from the compressor 11 flows into the first defrosting pipe 26 and has its pressure reduced to a medium pressure in the reducing device 18. The change of refrigerant at this time is represented by a line from point (b) to point (f) in FIG. 9.

The refrigerant whose pressure has been reduced to the medium pressure represented by point (f) in FIG. 9 passes through the second solenoid valve 17*b* and the second connection pipe 25*b*, and flows into the outdoor heat exchanger 13*b*. The refrigerant that has flowed into the outdoor heat exchanger 13*b* is cooled through heat exchange with frost accumulated on the outdoor heat exchanger 13*b*. In this manner, high-temperature high-pressure gas refrigerant discharged from the compressor 11 flows into the outdoor heat exchanger 13*b* so that frost accumulated on the outdoor heat exchanger 13*b* can be melted. The change of refrigerant at this time is represented as a change from point (f) to point (g) in FIG. 9. Here, refrigerant for defrosting has a saturation temperature higher than a frost temperature (0 degrees C.) and lower than or equal to 10 degrees C.

Part of refrigerant after defrosting passes through the second flow rate control device 15*b*. The refrigerant that has passed through the second flow rate control device 15*b* is combined with refrigerant that has flowed into the outdoor unit 10 from the indoor unit 30 through the second extension pipes 51*a*, 51 *b*, and 50 (point (h)). The combined refrigerant flows into the outdoor heat exchanger 13*a* through the second flow rate control device 15*a* and the first connection pipe 24*a*. The refrigerant that has flowed into the outdoor heat exchanger 13*a* is heated while cooling outdoor air through heat exchange with the outdoor air and becomes low-temperature low-pressure gas refrigerant. On the other hand, the other part of refrigerant that did not pass through the second flow rate control device 15*b* passes through the third solenoid valve 19*b* by way of the medium-pressure defrosting circuit described above. Then, the refrigerant has its pressure reduced to an injection pressure (point (i)) in the reducing device 20 and is injected into the compressor 11.

Then, a reason for setting the saturation temperature of refrigerant for refrigerant higher than 0 degrees C. and lower than or equal to 10 degrees C. will be described.

Figure 10:
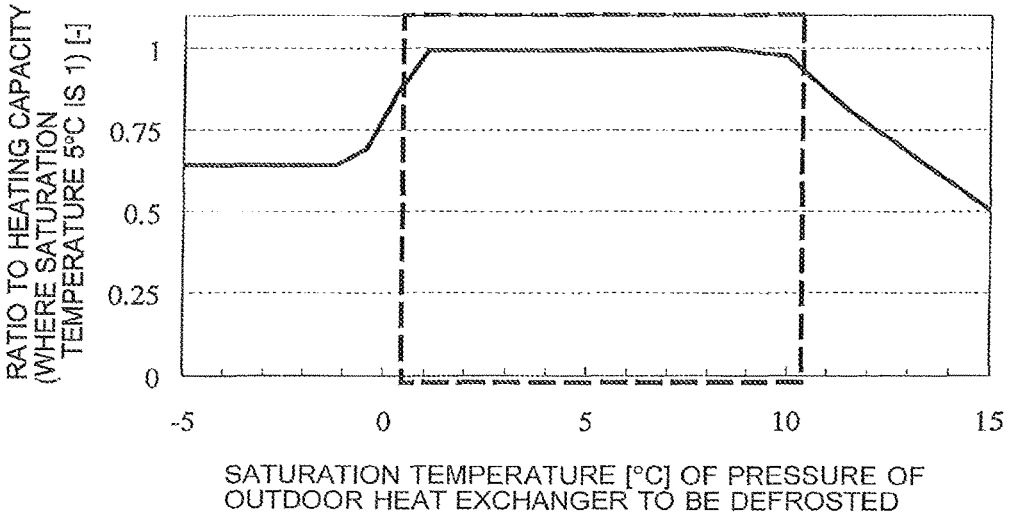
FIG. 10 shows a heating capacity ratio with respect to a pressure (in terms of saturated liquid temperature) of an outdoor heat exchanger 13 to be defrosted in the air-conditioning apparatus 100 according to Embodiment 1 of the present invention.
Figure 11:
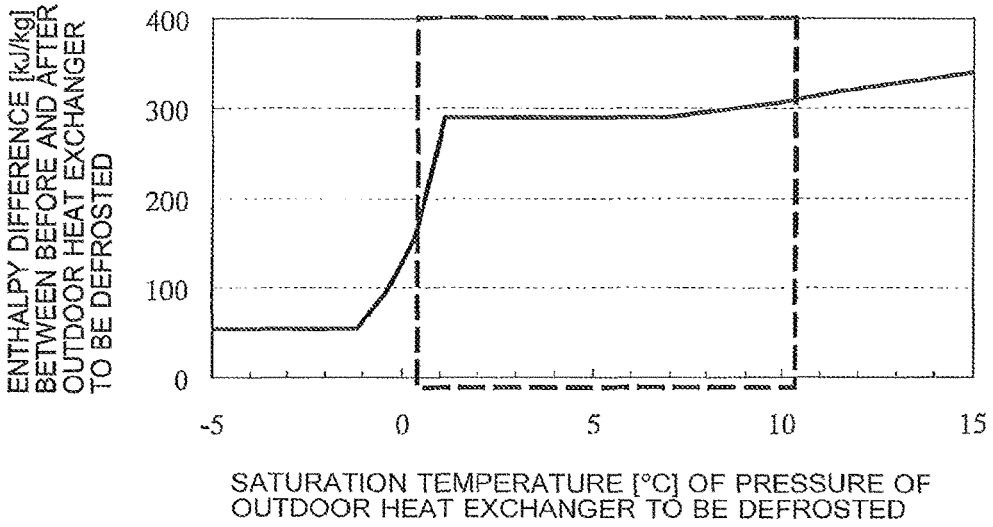
FIG. 11 shows an enthalpy difference between before inflow and after outflow of refrigerant into/from an outdoor heat exchanger 13 to be defrosted with respect to the pressure (in terms of saturated liquid temperature) in the air-conditioning apparatus 100 according to Embodiment 1 of the present invention.
Figure 12:
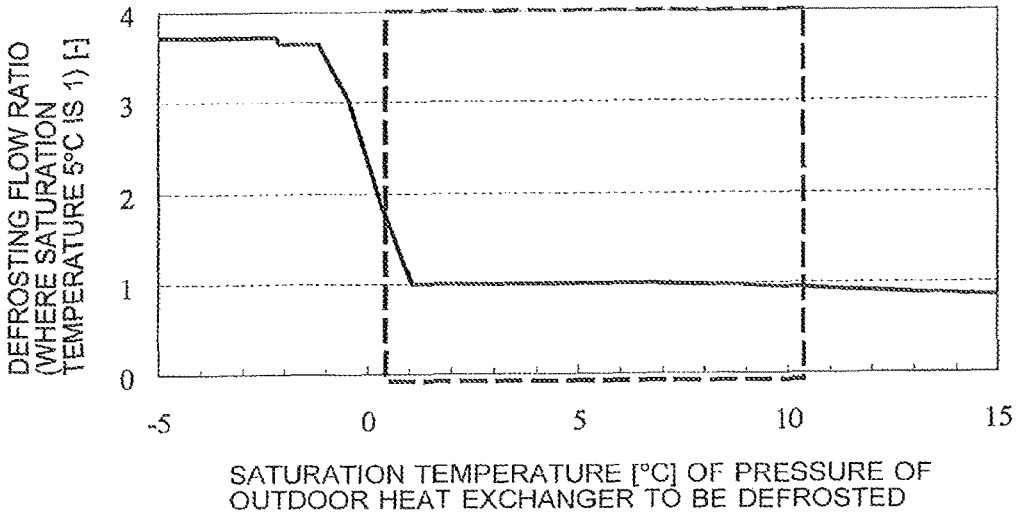
FIG. 12 shows a flow rate ratio of the outdoor heat exchanger 13 to be defrosted with respect to the pressure (in terms of saturated liquid temperature) in the air-conditioning apparatus 100 according to Embodiment 1 of the present invention.
Figure 13:
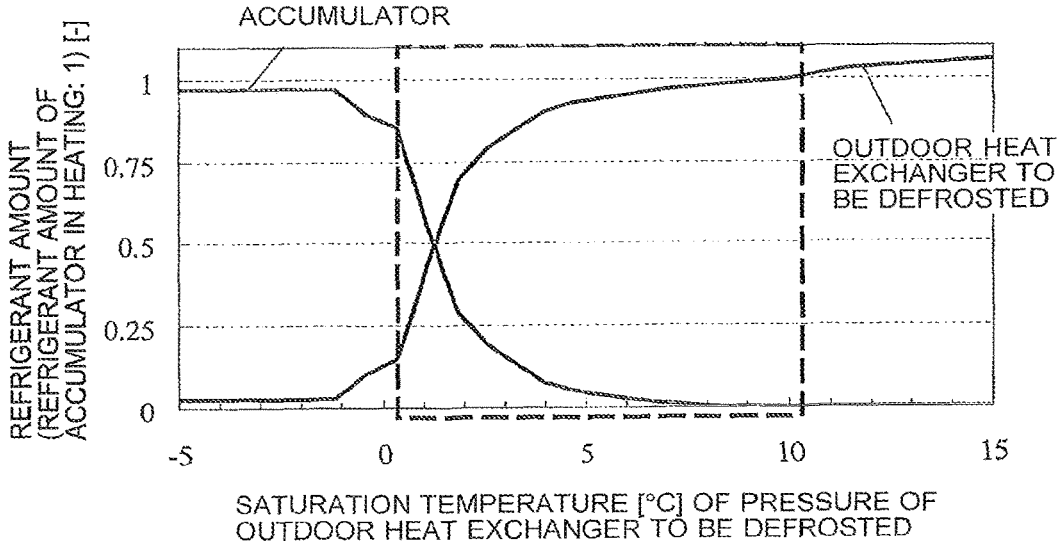
FIG. 13 shows a refrigerant amount of the outdoor heat exchanger 13 to be defrosted with respect to the pressure (in terms of saturated liquid temperature) in the air-conditioning apparatus 100 according to Embodiment 1 of the present invention.
Figure 14:
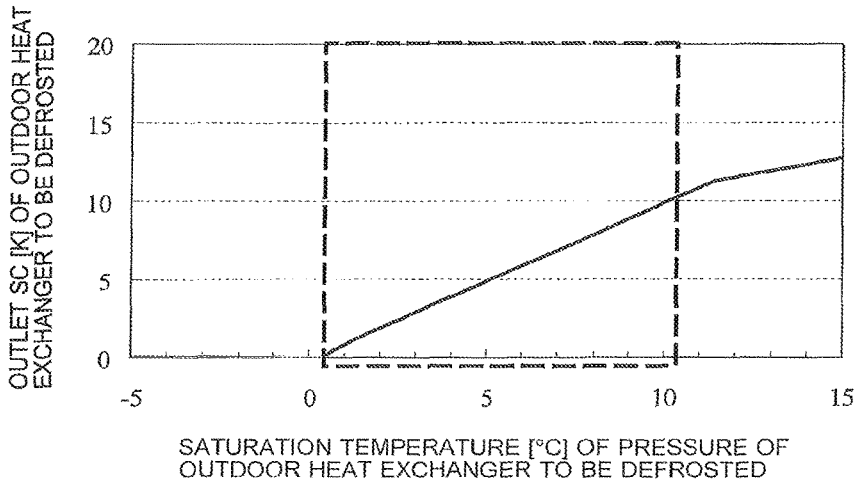
FIG. 14 shows a subcooling SC of refrigerant at an outlet of the at least one of the outdoor heat exchangers to be defrosted with respect to the pressure (in terms of saturated liquid temperature) of the outdoor heat exchanger 13 to be defrosted in the air-conditioning apparatus 100 according to Embodiment 1 of the present invention.

FIGS. 10 to 14 are graphs in which the pressure (converted into a saturated liquid temperature in each graph) of refrigerant in the outdoor heat exchanger 13 to be defrosted with a fixed defrosting capacity. In this example, R410A refrigerant is used as refrigerant in the refrigerant circuit. FIG. 10 shows a change in heating capacity with respect to a pressure change of refrigerant. FIG. 11 shows a change of an enthalpy difference of refrigerant between before inflow and after outflow of refrigerant into/from the outdoor heat exchanger 13 to be defrosted with respect to a pressure change of refrigerant. FIG. 12 shows a change of flow rate of refrigerant necessary for defrosting with respect to a pressure change of refrigerant. FIG. 13 shows a change of refrigerant amount in the accumulator 14 and the outdoor heat exchanger 13 with respect to a pressure change of refrigerant. FIG. 14 shows a change of subcooling SC at a refrigerant outlet of the outdoor heat exchanger 13 to be defrosted with respect to a pressure change of refrigerant.

FIG. 10 shows that the heating capacity of the outdoor heat exchanger 13 to be defrosted is high when the saturated liquid temperature of refrigerant is higher than 0 degrees C. and is lower than or equal to 10 degrees C., and is low otherwise. First, a reason for the decrease of the heating capacity when the saturated liquid temperature is lower than or equal to 0 degrees C. will be described. To melt frost, the temperature of refrigerant needs to be higher than 0 degrees C. As shown in FIG. 10, when the saturated liquid temperature is reduced to 0 degrees C. or less in order to melt frost, the location of point (g) in FIG. 9 becomes higher than the saturation gas enthalpy. Thus, condensation latent heat of refrigerant cannot be used, and the enthalpy difference between before inflow and after outflow of refrigerant into/from the outdoor heat exchanger 13 to be defrosted decreases (FIG. 11). At this time, to show a defrosting capacity substantially equal to that of refrigerant whose saturation temperature is higher than 0 degrees C. and lower than or equal to 10 degrees C., refrigerant in an amount about three to four times as much as refrigerant having a saturation temperature higher than 0 degrees C. and lower than or equal to 10 degrees C. needs to flow into the outdoor heat exchanger 13 to be defrosted. Thus, the amount of refrigerant that can be supplied to the indoor unit 30 for heating decreases, resulting in a decrease of the heating capacity. Accordingly, when the saturated liquid temperature is 0 degrees C. or less, the heating capacity decreases in a manner similar to the low-pressure defrosting described in Patent Literature 1. In view of this, the pressure of the outdoor heat exchanger 13 to be defrosted needs to be higher than 0 degrees C. in terms of saturated liquid temperature.

On the other hand, as the pressure of the outdoor heat exchanger 13 to be defrosted increases, the subcooling SC at the refrigerant outlet of the outdoor heat exchanger 13 to be defrosted increases, as shown in FIG. 14. Accordingly, the amount of liquid refrigerant increases, and the refrigerant density increases. In a typical multi-air-conditioning apparatus for buildings, the amount of necessary refrigerant is larger in cooling than in heating. Thus, surplus refrigerant is usually present in a reservoir such as the accumulator 14 in a heating operation. However, when the amount of refrigerant necessary for the outdoor heat exchanger 13 to be defrosted increases with the increase in pressure as shown in FIG. 13, the amount of refrigerant accumulated in the accumulator 14 decreases so that the accumulator 14 becomes empty at a saturation temperature of about 10 degrees C. When the accumulator 14 becomes empty of surplus refrigerant, shortage of refrigerant occurs in the refrigeration cycle so that the suction density of the compressor 11 decreases, for example, causing a decrease in the heating capacity. Although the upper limit of the saturation temperature can be increased by overcharging with refrigerant, the reliability of the air-conditioning apparatus might decrease because of, for example, overflow of liquid from the accumulator 14 in other operations. To prevent this, it is preferable to charge with an appropriate amount of refrigerant. There is another problem that an increase in the saturation temperature causes a temperature variation in the temperature difference between refrigerant in the outdoor heat exchanger 13 and frost, and thus, there arise a place where frost is readily melted and a place where frost is not readily melted.

For the foregoing reasons, the pressure of the outdoor heat exchanger 13 to be defrosted is preferably higher than 0 degrees C. and lower than or equal to 10 degrees C. in terms of saturation temperature. To reduce variations in melting by suppressing refrigerant movement during defrosting while making the most of the medium-pressure defrosting using latent heat, an optimum target value is obtained in a case where the subcooling SC at the outlet of the outdoor heat exchanger 13 to be defrosted is 0 (zero) K. In consideration of accuracies of, for example, a thermometer for detecting subcooling and a pressure gauge, the pressure of the outdoor heat exchanger 13 to be defrosted is preferably higher than 0 degrees C. and lower than or equal to 6 degrees C. in terms of saturation temperature in order to set the subcooling SC in the range from about 0 K to about 5K.

Then, an example of operations of the reducing devices 18 and 20 and the second flow rate control devices 15*a* and 15*b* during a heating defrosting operation will be described. During the heating defrosting operation, the control device 60 controls the opening degree of the second flow rate control device 15*b* such that the pressure of the outdoor heat exchanger 13*b* to be defrosted is higher than 0 degrees C. and lower than or equal to 10 degrees C. in terms of saturation temperature. On the other hand, regarding the opening degree, the second flow rate control device 15*a* is fully opened in order to enhance controllability by providing a differential pressure between before inflow and after outflow of refrigerant into/from the second flow rate control device 15*b*. The opening degree of the reducing device 18 is fixed in accordance with a predetermined necessary defrosting flow rate. This is because the difference between the discharge pressure of the compressor 11 and the pressure of the outdoor heat exchanger 13*b* to be defrosted does not significantly change during the heating defrosting operation. In addition, the reducing device 20 is controlled to have such an opening degree that prevents liquid compression of refrigerant in the compressor 11 in order to maintain reliability. The opening degree of the reducing device 20 is controlled to such a degree that refrigerant can be injected into the compressor 11 until the discharge superheat reaches about 10K to 20K, for example, in order to control, for example, the discharge temperature and discharge superheat of the compressor 11 and, thereby, increase the flow rate of refrigerant flowing into the indoor heat exchanger 31 serving as a condenser. Here, heat released from refrigerant for defrosting does not only move to frost accumulated on the outdoor heat exchanger 13*b* but also partially moves to the outdoor air in some cases. Thus, the control device 60 may control the reducing device 18 and the second flow rate control device 15*b* in such a manner that the flow rate increases as the outdoor-air temperature decreases. In this manner, the quantity of heat to be applied to frost is made constant, and thereby, the time for defrosting can be made constant, irrespective of the outdoor-air temperature.

The control device 60 may change the threshold value and the period of normal operation, for example, for use in determining the presence of frost accumulation, in accordance with the outdoor-air temperature. For example, the operating time is reduced so that the frost accumulation amount at the start of defrosting decreases as the outdoor-air temperature decreases in order to uniformize the quantity of heat applied to defrosting from refrigerant during the heating defrosting operation. In this manner, the resistance of the reducing device 18 can be made uniform. In addition, a reasonable capillary tube can be used. The control device 60 may set a threshold value to the outdoor-air temperature. For example, in a case where the outdoor-air temperature is determined to be a threshold temperature or higher (e.g., in a case where the outdoor-air temperature is −5 degrees C. or −10 degrees C.), the heating defrosting operation is performed, whereas in a case where the outdoor-air temperature is determined to be lower than the threshold temperature, heating of the indoor unit 30 is stopped and all the outdoor heat exchangers are defrosted. Specifically, in a case where the outdoor-air temperature is lower than or equal to 0 degrees C., such as −5 degrees C. or −10 degrees C., the absolute humidity of outdoor air is originally low and the frost accumulation amount is small. Thus, the period of normal operation until the frost accumulation amount becomes constant increases. Accordingly, even when heating of the indoor unit 30 is stopped and defrosting of all the outdoor heat exchangers 13 (full-surface defrosting) is performed, the proportion of a period in which heating of the indoor unit 30 is stopped is low. In the case of the heating defrosting operation, in consideration of heat transfer from the outdoor heat exchanger 13 to be defrosted to the outdoor air, a higher efficiency is obtained by performing full-surface defrosting with a heating operation stopped, for example, in some cases. In view of this, a heating-stop defrosting operation mode in which full-surface defrosting is performed may be selected, in addition to the heating-and-defrosting operation mode. For example, defrosting can be efficiently performed by selecting an operation mode for defrosting based on the outdoor-air temperature.

In a case where the outdoor heat exchangers 13*a* and 13*b* are integrally formed and outdoor air is conveyed to the outdoor heat exchanger 13 to be defrosted by the outdoor fan 21, fan power may be changed to decrease as the outdoor-air temperature decreases. Thus, the amount of heat transferred from the outdoor heat exchanger 13 to be defrosted can be reduced in the heating defrosting operation.

[Control Flow]

Figure 15:
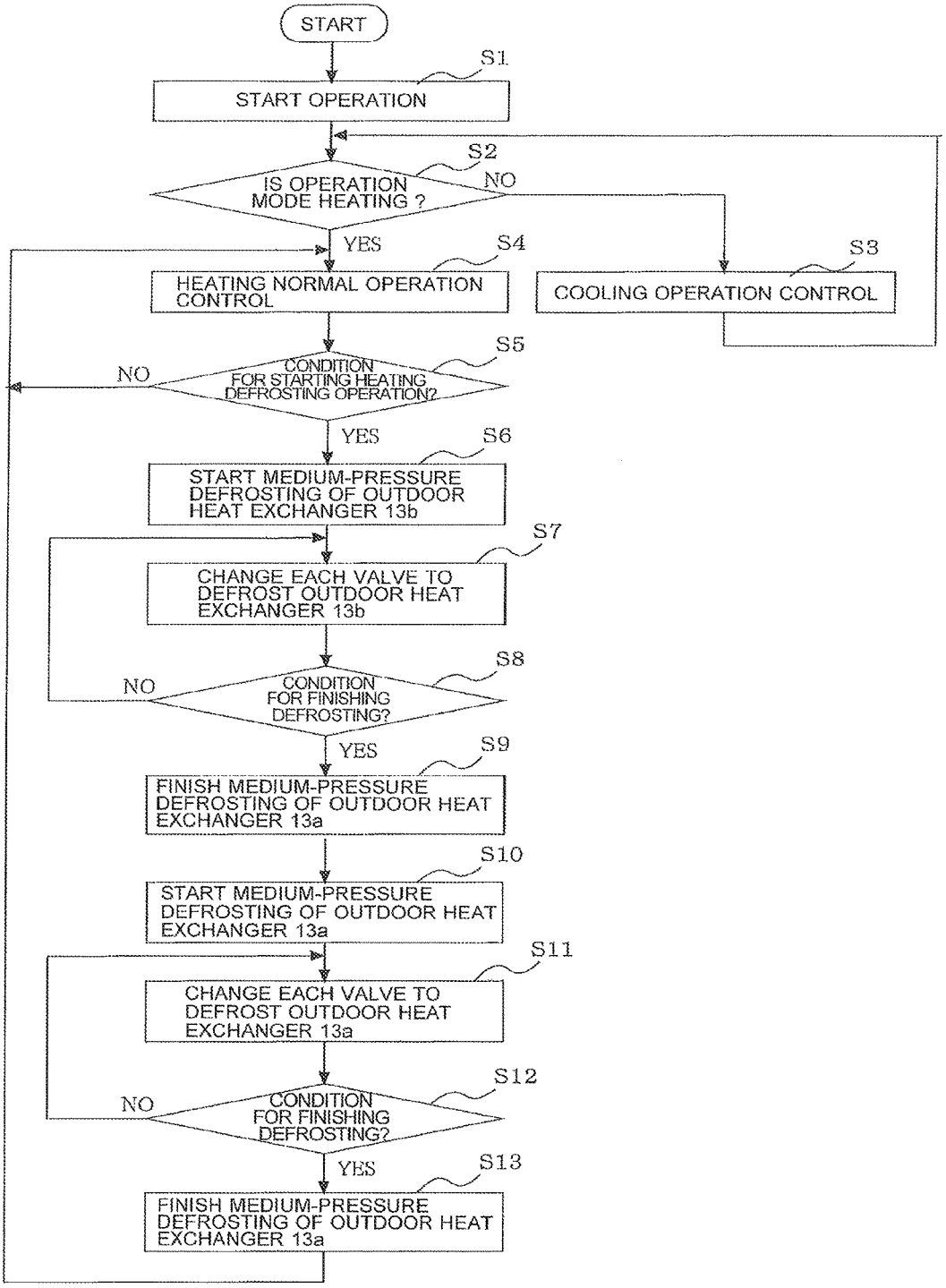
FIG. 15 is a flowchart showing control of a control device 60 in the air-conditioning apparatus 100 according to Embodiment 1 of the present invention.

FIG. 15 is a flowchart showing control of the control device 60 in the air-conditioning apparatus 100 according to Embodiment 1 of the present invention. Referring to FIG. 15, a control process performed by the control device 60 in this embodiment will be more specifically described. Here, the case of performing only a heating defrosting operation will be described with reference to FIG. 15.

When the air-conditioning apparatus 100 starts an operation (S1), it is determined whether or not the indoor units 30*a* and 30*b* perform heating (whether or not the operation mode is heating) (S2). If it is determined that the operation mode is cooling, control of a normal cooling operation is performed (S3).

On the other hand, if it is determined that the operation mode is heating, control of a normal heating operation is performed (S4). In the normal heating operation, in consideration of degradation of heat transmission performance of the outdoor heat exchanger 13 caused by decrease in, for example, heat transmission and the airflow rate due to frost accumulation, for example, it is determined whether or not conditions for starting a heating defrosting operation (whether or not frost is accumulated), based on Equation (1) (S5). In Equation (1), x1 is about 5 K to 20 K. If it is determined whether frost accumulation occurs or not by using a temperature sensor, a pressure sensor, and a sensor for measuring a frost accumulation amount, for example, the determination does not depend on a suction pressure with respect to conditions for starting defrosting.

$$\text{(Saturation temperature of suction pressure)} < \text{(outdoor-air temperature)} - x1 \quad (1)$$

For example, if it is determined that conditions for starting the heating defrosting operation are satisfied based on Equation (1), for example, a heating defrosting operation of defrosting the outdoor heat exchanger 13 starts. Here, control in the case of defrosting the outdoor heat exchanger 13*b* disposed at a lower stage and the outdoor heat exchanger 13*a* disposed at an upper stage in the outdoor heat exchangers 13 shown in FIG. 2 in this order will be described as an example. Thus, defrosting (medium-pressure defrosting) is first performed on the outdoor heat exchanger 13*b* (S6). The order of defrosting may be reversed.

As described above, the valves in a heating normal operation before a heating defrosting operation are in the states indicated in the level of "heating normal operation" in FIG. 3. From these states, the valves are changed to the states indicated in the level of "13*a*: Evaporator 13*b*: Defrosting" in "heating defrosting operation" in FIG. 3, and a heating defrosting operation is performed (S7).

| | |
|---|---|
| (a) First solenoid valve 16b | OFF |
| (b) Second solenoid valve 17b | ON |
| (c) Third solenoid valve 19b | ON |
| (d) Reducing device 18 | Open to a predetermined opening degree |
| (e) Reducing device 20 | Open to a predetermined opening degree |
| (f) Second flow rate control device 15a | Fully open |
| (g) Second flow rate control device 15b | Control starts |
| (h) Reducing device 20 | Control starts |

It is determined whether defrosting end conditions are satisfied or not depending on melting of frost on the outdoor heat exchanger 13*b* to be defrosted (S8). If it is determined that the defrosting end conditions are not satisfied, a heating defrosting operation is performed in such a manner that the outdoor heat exchanger 13*b* is defrosted and the outdoor heat exchanger 13*a* serves as an evaporator. Specifically, when the heating defrosting operation continues so that frost accumulated on the outdoor heat exchanger 13*b* starts being melted, the refrigerant temperature in the first connection pipe 24*b* increases. Thus, for the defrosting end conditions, the defrosting end conditions are determined to be satisfied if a temperature sensor attached to the first connection pipe 24*b* exceeds a threshold value as shown in Equation (2) below, for example. Here, x2 is set at 3 to 10 degrees C., for example.

$$(\text{Refrigerant temperature of first connection pipe } 24) > x2 \quad (2)$$

If Equation (2) is satisfied and the defrosting end conditions are determined to be satisfied, defrosting of the outdoor heat exchanger 13*b* is finished (S9). At this time, the states of the valves are changed as follows:

| | |
|---|---|
| (a) Second solenoid valve 17b | OFF |
| (b) Third solenoid valve 19b | OFF |
| (c) First solenoid valve 16b | ON |
| (d) Second flow rate control device 15a, 15b | Normal intermediate-pressure control |

In addition, the valves are changed to the states indicated in the levels of "13*a*: Defrosting 13*b*: Evaporator" in "heating defrosting operation" in FIG. 3, and a heating defrosting operation in which the outdoor heat exchanger 13*a* is defrosted starts (S10). Although steps S10 to S13 are performed on the values indicated by reference numerals different from those in steps S6 to S9, steps S10 to S13 themselves are the same as steps S6 to S9.

When defrosting of both the lower-stage outdoor heat exchanger 13*b* and the upper-stage outdoor heat exchanger 13*a* is completed as described above and the heating defrosting operation indicated by S6 to S13 is finished, the process returns to S4, and a heating normal operation is performed.

Here, in a heating defrosting operation, the outdoor heat exchangers 13 are sequentially defrosted each at least once. Specifically, when defrosting of the last outdoor heat exchanger 13 is finished, a temperature sensor disposed in the refrigerant circuit, for example, determines that frost is accumulated on the initially defrosted outdoor heat exchanger 13 to degrade heat transmission performance, the initially defrosted outdoor heat exchanger 13 may be defrosted at the second time for a short time.

As described above, in the air-conditioning apparatus 100 according to Embodiment 1, a heating defrosting operation is performed in such a manner that defrosting is performed while refrigerant is sent toward the indoor unit 30. Thus, the room can be continuously heated. At this time, part of or the whole of refrigerant that has flowed out of the outdoor heat exchanger 13 that is being defrosted can be injected into the compressor 11 by adjusting the opening degree of at least one (mainly the reducing device 20) of the reducing device 20 or the second flow rate control device 15. Thus, the amount of refrigerant supplied to the indoor unit 30 is increased so that heating capacity can be enhanced. In this operation, since each of the outdoor heat exchangers 13 is defrosted at least once, the efficiency in a normal heating operation can be increased.

In addition, part of refrigerant that has flowed out of the outdoor heat exchanger 13 being defrosted can be caused to flow into a main refrigerant circuit upstream of the outdoor heat exchanger 13 serving as an evaporator, by adjusting the opening degree of at least one (mainly the second flow rate control device 15) of the reducing device 20 and the second flow rate control device 15. Thus, the defrosting efficiency can be enhanced, the amount of refrigerant flowing into the outdoor heat exchanger 13 serving as an evaporator increases, and the amount of heat absorption from the outdoor air increases. In addition, a decrease in the suction pressure of the compressor 11 can be suppressed.

Furthermore, the reducing device 20 is controlled to an opening degree at which refrigerant is injected in such a manner that the discharge superheat of refrigerant discharged from the compressor 11 is about 10K to 20K. Thus, the amount of refrigerant flowing into the indoor heat exchanger 31 serving as a condenser increases while the reliability is maintained so as to prevent refrigerant from liquid compression in the compressor 11, thereby enhancing the heating capacity.

In the air-conditioning apparatus 100 of this embodiment, part of high-temperature high-pressure gas refrigerant branched off from the discharge pipe 22 is subjected to pressure reduction to a pressure (medium pressure) higher than 0 degrees C. and lower than or equal to 10 degrees C., in terms of saturation temperature, as compared to the temperature of frost, and the resulting refrigerant flows into the outdoor heat exchanger 13 to be defrosted. Thus, defrosting can be performed while utilizing condensation latent heat of refrigerant.

In the air-conditioning apparatus 100 of this embodiment, the saturation temperature is higher than 0 degrees C. and lower than or equal to 10 degrees C. so as to reduce the temperature difference between the saturation temperature and the frost temperature. Thus, the subcooling (degree of subcooling) of refrigerant at the outlet of the outdoor heat exchanger 13 to be defrosted is as small as about 5 K. Thus, a small amount of refrigerant is necessary for defrosting, and a shortage of refrigerant circulating in the main refrigerant circuit can be avoided. In addition, an area of two-phase gas-liquid is increased for refrigerant in the heat transfer tube of the outdoor heat exchanger 13 to be defrosted, an area where the temperature difference between the saturation temperature and the frost temperature is uniform, and the amount of defrosting in the entire heat exchangers can be uniformized.

In the air-conditioning apparatus 100 of this embodiment, refrigerant that has flowed out of the outdoor heat exchanger 13 to be defrosted flows into the other outdoor heat exchanger 13 serving as an evaporator. Thus, the evaporative capacity in the refrigeration cycle is maintained, and a decrease in the suction pressure can be suppressed. In addition, liquid back to the compressor 11 can be prevented. Furthermore, the flow rate control of the reducing device 18 can change the defrosting capacity. Thus, the increase in the flow rate of the reducing device 18 as the outdoor-air temperature decreases, can uniformize the time for defrosting.

In the air-conditioning apparatus 100 of this embodiment, the time necessary for defrosting can be uniformized by changing a criterion for determining whether to perform a heating defrosting operation or not based on the outdoor-air temperature, for example. In addition, since the heating defrosting operation and the heating-stop defrosting operation can be selectively performed based on the outdoor-air temperature, efficient defrosting can be selectively performed. Furthermore, since output power of the outdoor fan 21 is changed based on the outdoor-air temperature, the amount of heat transferred to the outdoor air from refrigerant for defrosting can be reduced.

Embodiment 2

Figure 16:
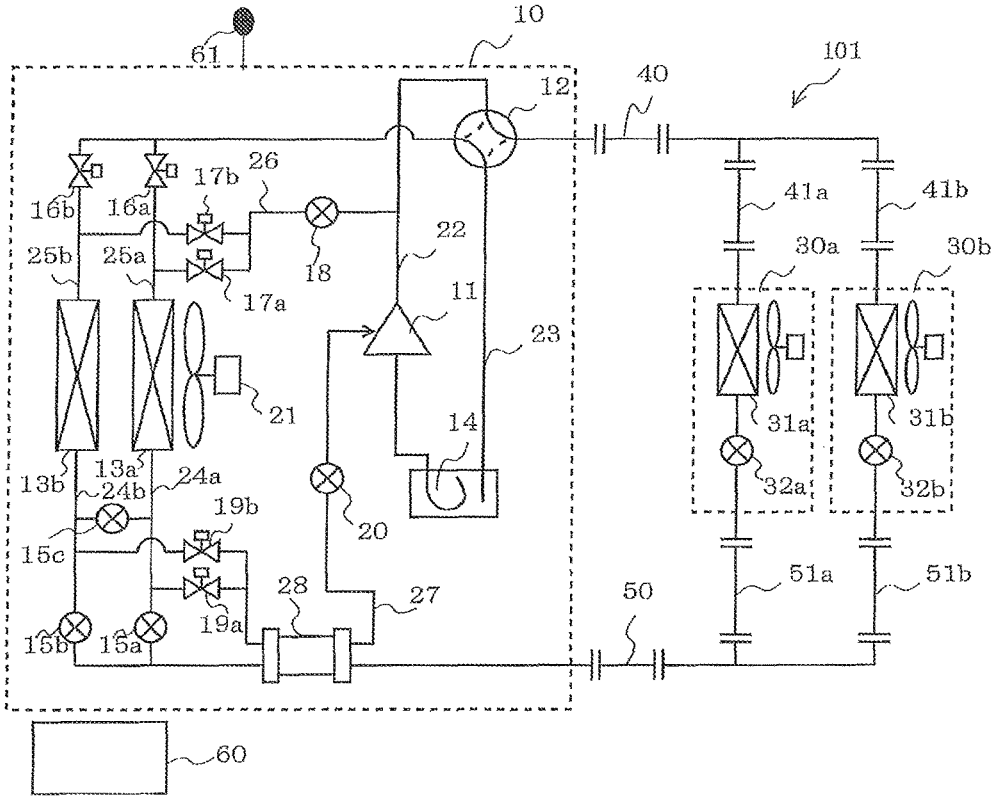
FIG. 16 illustrates a configuration of an air-conditioning apparatus 101 according to Embodiment 2 of the present invention.

FIG. 16 illustrates a configuration of an air-conditioning apparatus 101 according to Embodiment 2 of the present invention. In FIG. 16, devices designated by the same reference characters, for example, perform similar operations, for example, to those described in Embodiment 1. Part of the configuration of the air-conditioning apparatus 101 different from that of the air-conditioning apparatus 100 of the Embodiment 1 will be hereinafter mainly described.

The air-conditioning apparatus 101 according to Embodiment 2 includes a third flow rate control device 15*c* and a refrigerant-to-refrigerant heat exchanger 28 (hereinafter referred to as a refrigerant-refrigerant heat exchanger 28) in addition to the configuration of the air-conditioning apparatus 100 of Embodiment 1. The third flow rate control device 15*c* is disposed in a pipe connecting a first connection pipe 24*a* and a first connection pipe 24*b* for bypassing. The third flow rate control device 15*c* is constituted by, for example, a valve having a variable opening degree, such as an electronically controlled expansion valve. The third flow rate control device 15*c* of this embodiment corresponds to a "third pressure adjustment device" of the present invention. Thus, although the air-conditioning apparatus 101 illustrated in FIG. 16 includes the second flow rate control devices 15*a* and 15*b*, the second flow rate control devices 15*a* and 15*b* are not necessarily provided.

FIG. 17 is a table showing states of ON/OFF (opening/closing) or opening degree adjustment of devices (valves) having valves in operations of the air-conditioning apparatus 101 according to Embodiment 2 of the present invention. Operations of the second flow rate control devices 15*a* and 15*b* and the third flow rate control device 15*c* in the air-conditioning apparatus 101 of this embodiment are different from those in Embodiment 1.

In a heating defrosting operation, the third flow rate control device 15*c* causes refrigerant that has flowed from an outdoor heat exchanger 13 to be defrosted to flow into a part upstream of an outdoor heat exchanger 13 serving as an evaporator. The third flow rate control device 15*c* is controlled by a control device 60 in such a manner that a pressure of the outdoor heat exchanger 13 to be defrosted is a medium pressure higher than 0 degrees C. and lower than or equal to 10 degrees C. On the other hand, the second flow rate control device 15*a* or 15*b*, which controls the pressure of the outdoor heat exchanger 13 to be defrosted in Embodiment 1, is closed. The second flow rate control device 15*a* or 15*b*, which is fully open in Embodiment 1, is controlled to have an opening degree with which the saturation temperature at an intermediate pressure of, for example, a second extension pipe 50 is about 0 degrees C. to 20 degrees C.

Figure 18:
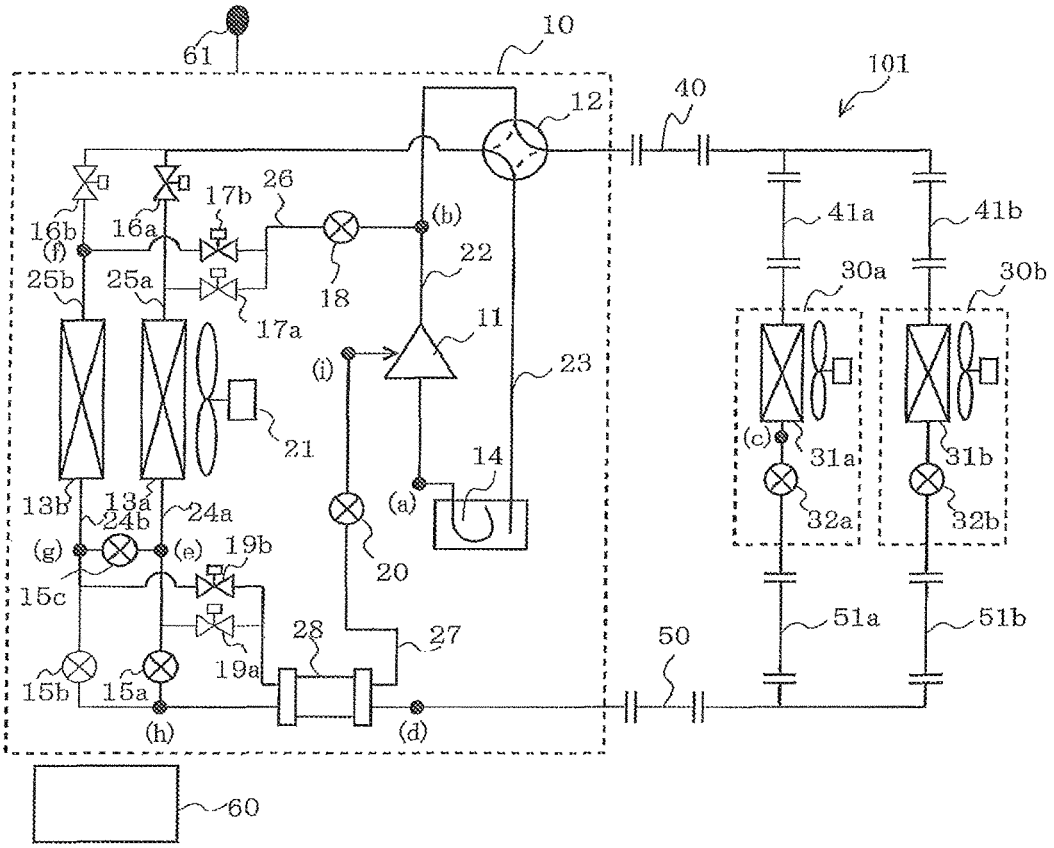
FIG. 18 is a view showing a flow of refrigerant in a heating defrosting operation of the air-conditioning apparatus 101 according to Embodiment 2 of the present invention.
Figure 19:
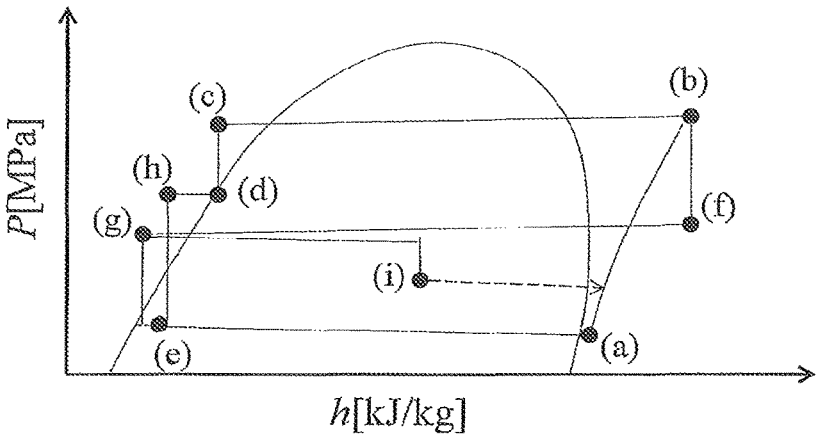
FIG. 19 is a P-h diagram in the heating defrosting operation of the air-conditioning apparatus 101 according to Embodiment 2 of the present invention.

FIG. 18 is a view showing a flow of refrigerant in a heating defrosting operation of the air-conditioning apparatus 101 according to Embodiment 2 of the present invention. In FIG. 18, bold lines represent sections where refrigerant flows in the heating defrosting operation, and thin lines represent sections where refrigerant does not flow. FIG. 19 is a P-h diagram in the heating defrosting operation of the air-conditioning apparatus 101 according to Embodiment 2 of the present invention. In FIG. 19, point (a) to point (i) represent the states of refrigerant at points denoted by the same characters in FIG. 18.

If it is determined that defrosting for eliminating frost accumulation is necessary in a heating normal operation, the control device 60 closes a first solenoid valve 16*b* and a second flow rate control device 15*b* corresponding to the outdoor heat exchanger 13*b* to be defrosted. The control device 60 opens a second solenoid valve 17*b* and a third solenoid valve 19*b* and sets the opening degrees of the reducing device 18 and the reducing device 20 at predetermined opening degrees. The control device 60 sets the opening degree of the third flow rate control device 15*c* at a predetermined opening degree.

In this manner, a refrigerant path (first refrigerant path) passing through a compressor 11, a reducing device 18, the second solenoid valve 17*b*, the outdoor heat exchanger 13*b*, and the third flow rate control device 15*c* in this order is formed. A refrigerant path (medium-pressure defrosting circuit, second refrigerant path) serving as an injection part and passing through the compressor 11, the reducing device 18, the second solenoid valve 17*b*, the outdoor heat exchanger 13*b*, the third solenoid valve 19*b*, the refrigerant-refrigerant heat exchanger 28, the reducing device 20, and the compressor 11 in this order is also formed. Then, a heating defrosting operation starts.

When the heating defrosting operation starts, part of high-temperature high-pressure gas refrigerant discharged from the compressor 11 flows into a first defrosting pipe 26 and has its pressure reduced to a medium pressure in the reducing device 18. The change of refrigerant at this time is represented by a line from point (b) to point (f) in FIG. 19.

The refrigerant whose pressure has been reduced to the medium pressure represented by point (f) in FIG. 19 passes through the second solenoid valve 17*b* and the second connection pipe 25*b*, and flows into the outdoor heat exchanger 13*b*. The refrigerant that has flowed into the outdoor heat exchanger 13*b* is cooled through heat exchange with frost accumulated on the outdoor heat exchanger 13*b*. The change of refrigerant at this time is represented by a change from point (f) to point (g) in FIG. 19. Here, refrigerant for defrosting is at a saturation temperature higher than or equal to frost temperature (0 degrees C.) and lower than or equal to 10 degrees C.

The refrigerant used for defrosting the outdoor heat exchanger 13*b* is branched into to refrigerant parts. One of the two refrigerant parts passes through the third flow rate control device 15*c* and flows into the main refrigerant circuit from the first connection pipe 24*a* between the second flow rate control device 15*a* and the outdoor heat exchanger 13*a*

(point (e)). This refrigerant flows into the outdoor heat exchanger 13*a* serving as an evaporator and evaporates.

The other refrigerant part passes through the third solenoid valve 19*b*, and exchanges heat, in the refrigerant-refrigerant heat exchanger 28, with refrigerant for heating flowing at an intermediate pressure at which a saturation temperature is higher than that at a medium pressure represented by point (f). The refrigerant heated by the heat exchange has its pressure reduced to an injection pressure in the reducing device 20 (point (i)). At this time, refrigerant for heating is cooled through heat exchange. The change of refrigerant at this time is represented by a change from point (d) to point (h) in FIG. 19.

As described above, in the air-conditioning apparatus 101 according to Embodiment 2, refrigerant that has passed through the outdoor heat exchanger 13 to be defrosted flows under a low pressure (corresponding to a suction pressure of the compressor 11). Thus, the control device 60 can perform control for the intermediate pressure (point (d)) and control of the medium pressure (point (f)), separately from each other. Since the intermediate pressure may be higher than the medium pressure, valves having small Cv values can be used as the second flow rate control devices 15*a* and 15*b*.

In a case where the intermediate pressure is higher than the medium pressure, refrigerant to be injected into the compressor 11 after having passed through the outdoor heat exchanger 13 to be defrosted exchanges heat, in the refrigerant-refrigerant heat exchanger 28, with refrigerant at the intermediate pressure that has returned from the indoor units 30*a* and 30*b* to the outdoor unit 10 so that the refrigerant to be injected is heated and refrigerant flowing in the main refrigerant circuit is cooled (subcooled). Thus, in the outdoor heat exchanger 13 serving as an evaporator, an enthalpy difference can be increased, and the amount of heat absorption from the outdoor air can be increased, thereby enhancing the heating capacity. In this aspect, in the air-conditioning apparatus 100 of Embodiment 1 described above, since refrigerant that has passed through the outdoor heat exchanger 13 to be defrosted returns to the mainstream, the intermediate pressure (pressure of the second extension pipe 50) needs to be made lower than the medium pressure (pressure of refrigerant flowing into the outdoor heat exchanger 13 to be defrosted).

Embodiment 3

Figure 20:
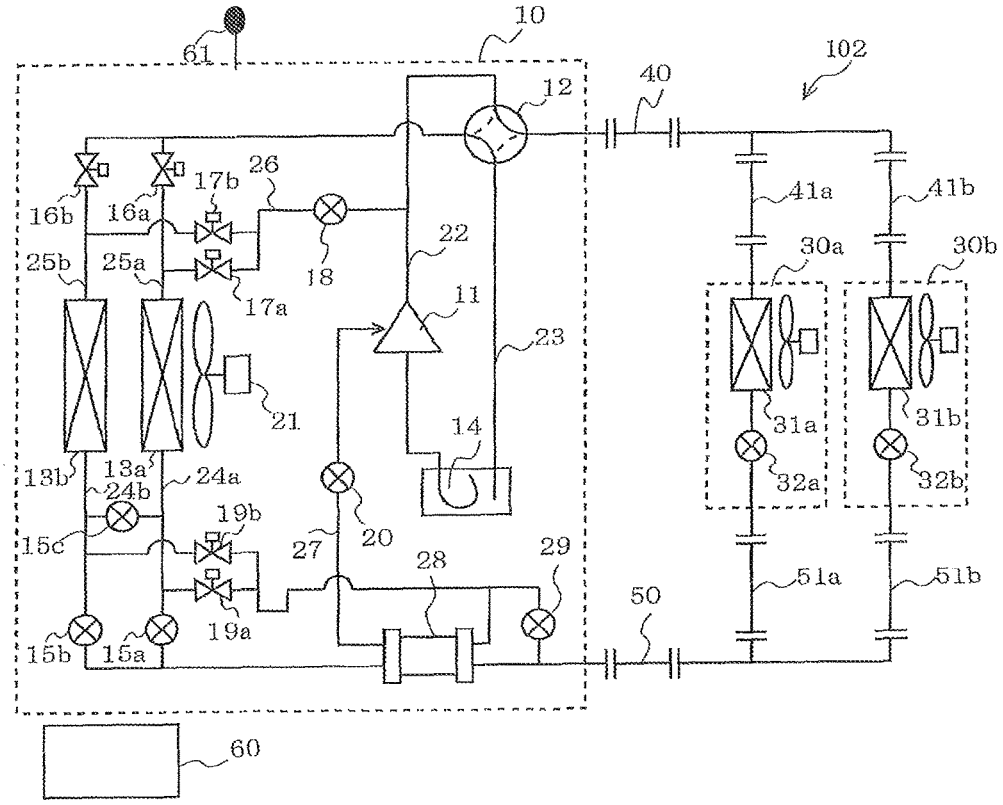
FIG. 20 illustrates a configuration of an air-conditioning apparatus 102 according to Embodiment 3 of the present invention.

FIG. 20 illustrates a configuration of an air-conditioning apparatus 102 according to Embodiment 3 of the present invention. In FIG. 20, devices designated by the same reference characters as those in FIGS. 1 and 16, for example, perform similar operations, for example, to those described in Embodiment 1 or 2. Thus, part of the configuration of the air-conditioning apparatus 102 of this embodiment different from that of the air-conditioning apparatus 101 of the Embodiment 2 will be hereinafter mainly described.

In addition to the configuration of the air-conditioning apparatus 101 of Embodiment 2 described above, the air-conditioning apparatus 102 according to Embodiment 3 includes a fourth flow rate control device 29 for performing pressure adjustment in such a manner that refrigerant flows from a pipe (pipe between a second extension pipe 50 and second flow rate control devices 15*a* and 15*b*) at an intermediate pressure in a main refrigerant circuit to a part upstream of a refrigerant-refrigerant heat exchanger 28 of a second defrosting pipe 27. In Embodiment 3, a third flow rate control device 15*c* also corresponds to a "third reducing device" of the present invention. The fourth flow rate control device 29 corresponds to a "fourth pressure adjustment device" of the present invention.

In a manner similar to Embodiment 2, in a heating defrosting operation of Embodiment 3, a refrigerant path (first refrigerant path) passing through a compressor 11, a reducing device 18, a second solenoid valve 17*b*, an outdoor heat exchanger 13*b*, and the third flow rate control device 15*c* in this order is formed. A refrigerant path (medium-pressure defrosting circuit, second refrigerant path) serving as an injection part (port) and passing through the compressor 11, the reducing device 18, the second solenoid valve 17*b*, the outdoor heat exchanger 13*b*, the third solenoid valve 19*b*, the refrigerant-refrigerant heat exchanger 28, the reducing device 20, and the compressor 11 in this order is also formed.

In the heating defrosting operation of Embodiment 3, the third flow rate control device 15*c* and the fourth flow rate control device 29 control a medium pressure. Specifically, in a case where the third flow rate control device 15*c* is fully closed in controlling the medium pressure with a low flow rate of refrigerant for defrosting, the control device 60 adjusts the opening degree of the fourth flow rate control device 29 so as to increase the medium pressure.

Refrigerant that has passed through the third solenoid valve 19*b* exchanges heat with refrigerant for heating in the refrigerant-refrigerant heat exchanger 28, in a manner similar to Embodiment 2. Then, the degree of subcooling of refrigerant for heating is increased, and the amount of heat absorption in the outdoor heat exchanger 13 serving as an evaporator is increased, thereby enhancing the heating capacity.

As described above, in the air-conditioning apparatus 102 of Embodiment 3, the fourth flow rate control device 29 is made open even in a case where the flow rate of refrigerant for defrosting is low so that refrigerant at a medium pressure subjected to pressure adjustment is caused to flow into the outdoor heat exchanger 13 to be defrosted, and thereby, medium pressure control on the outdoor heat exchanger 13 to be defrosted can be stably performed. In addition, heat exchange in the refrigerant-refrigerant heat exchanger 28 can increase the degree of subcooling of refrigerant for heating. Thus, the amount of heat absorption from outdoor air can be increased in the outdoor heat exchanger 13 serving as an evaporator, thereby enhancing the heating capacity.

Embodiment 4

Figure 21:
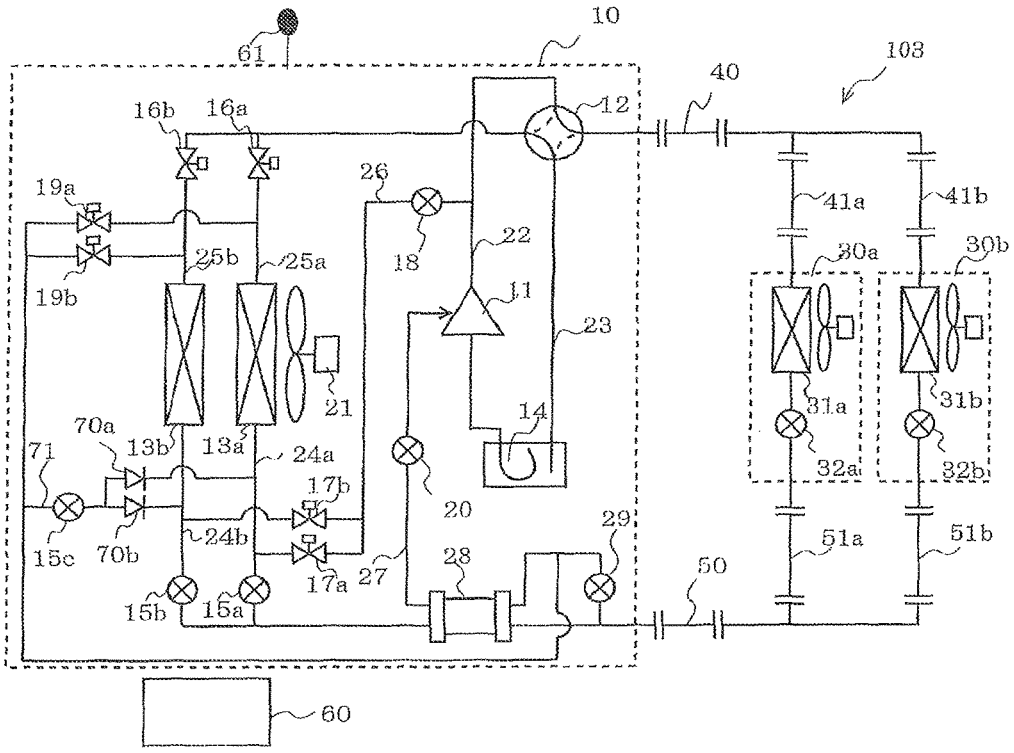
FIG. 21 illustrates a configuration of an air-conditioning apparatus 103 according to Embodiment 4 of the present invention.

FIG. 21 illustrates a configuration of an air-conditioning apparatus 103 according to Embodiment 4 of the present invention. In FIG. 21, devices designated by the same reference characters as those in FIG. 20, for example, perform similar operations, for example, to those described in Embodiments 1 to 3. Part of the configuration of the air-conditioning apparatus 103 of this embodiment different from that of the air-conditioning apparatus 102 of the Embodiment 3 will be hereinafter mainly described.

In the air-conditioning apparatus 103 according to Embodiment 4, one end of a first defrosting pipe 26 is connected to first connection pipes 24*a* and 24*b*, instead of the configuration of the air-conditioning apparatus 102 of Embodiment 3. In addition, one end of the second defrosting pipe 27 is connected to second connection pipes 25*a* and 25*b*.

The air-conditioning apparatus 102 of Embodiment 3 includes the third flow rate control device for connecting the first connection pipes 24*a* and 24*b* for bypassing. Alternatively, the air-conditioning apparatus 103 of this embodiment includes a third flow rate control device 15*c* and check valves 70*a* and 70*b* in such a manner that refrigerant used for defrosting passes through the second defrosting pipe 27 and a third defrosting pipe 71 and flows toward a first connection pipe 24*a* or 24*b*. A third flow rate control device 15*c* of an air-conditioning apparatus 104 and a fourth flow rate control device 29 of the air-conditioning apparatus 103 in Embodiment 4 respectively correspond to a "third reducing device" and a "fourth reducing device" of the present invention.

Figure 22:
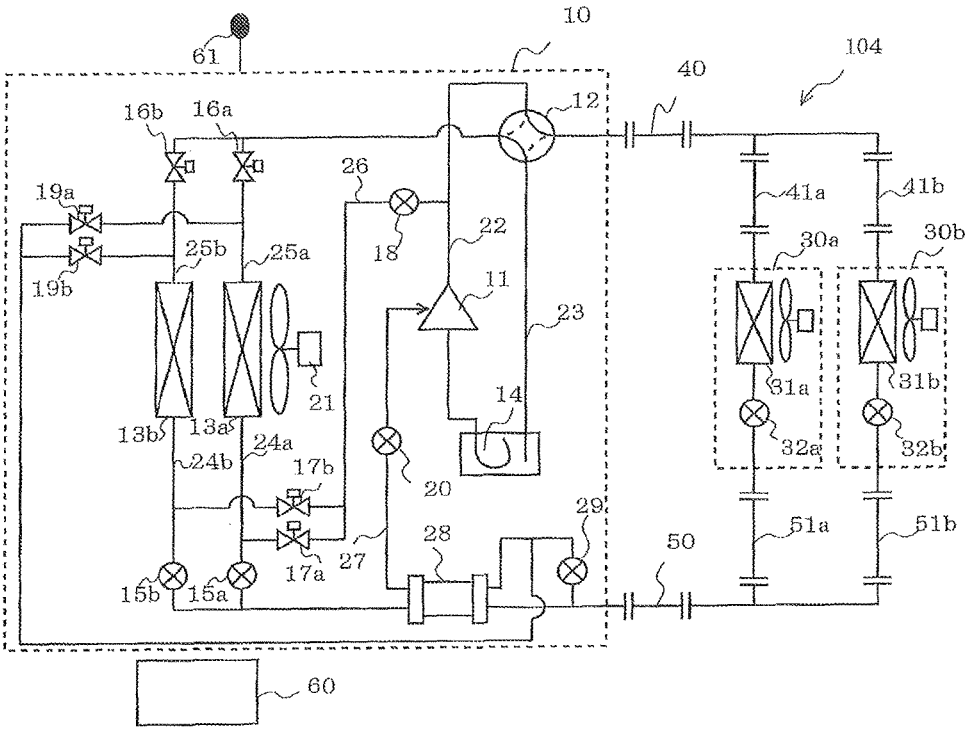
FIG. 22 illustrates a configuration of an air-conditioning apparatus 104 according to Embodiment 4 of the present invention.

FIG. 22 illustrates a configuration of the air-conditioning apparatus 104 according to Embodiment 4 of the present invention. In the air-conditioning apparatus 104 illustrated in FIG. 22, the third flow rate control device 15*c* and the check valves 70*a* and 70*b* of the air-conditioning apparatus 103 are omitted.

In the configurations illustrated in FIGS. 21 and 22, refrigerant in the outdoor heat exchangers 13 of the air-conditioning apparatuses 103 and 104 of this embodiment flows in a reverse direction to the flow of refrigerant in the air-conditioning apparatuses 100 to 102 of Embodiments 1 to 3.

If it is determined that defrosting for eliminating frost accumulation is necessary in a normal heating operation, the control device 60 closes a first solenoid valve 16*b* corresponding to an outdoor heat exchanger 13*b* to be defrosted and fully closes a second flow rate control device 15*b*. The control device 60 opens a second solenoid valve 17*b* and a third solenoid valve 19*b* and adjusts the opening degree of the reducing device 18 to a predetermined opening degree. The control device 60 opens the third flow rate control device 15*c* in the air-conditioning apparatus 104 and opens the fourth flow rate control device 29 in the air-conditioning apparatus 103.

In this manner, in the air-conditioning apparatus 103, a refrigerant path (first refrigerant path) passing through a compressor 11, the reducing device 18, the second solenoid valve 17*b*, an outdoor heat exchanger 13*b*, the third solenoid valve 19*b*, the third flow rate control device 15*c*, and the first connection pipe 24*a* in this order is formed. In the air-conditioning apparatus 104, a refrigerant path (first refrigerant path) passing through the compressor 11, the reducing device 18, the second solenoid valve 17*b*, the outdoor heat exchanger 13*b*, the third solenoid valve 19*b*, the fourth flow rate control device 29, the refrigerant heat exchanger 28, the second flow rate control device 15*a*, and the first connection pipe 24*a* in this order is also formed. As a second path, a refrigerant path (medium-pressure defrosting circuit, second refrigerant path) serving as an injection part (port) and passing through the compressor 11, the reducing device 18, the second solenoid valve 17*b*, the outdoor heat exchanger 13*b*, the third solenoid valve 19*b*, the refrigerant heat exchanger 28, the reducing device 20, and the compressor 11 in this order is formed. Then, a heating defrosting operation starts.

In the heating defrosting operation, the control device 60 controls the opening degree of the third flow rate control device 15*c* or the fourth flow rate control device 29 in such a manner that the pressure (medium pressure) of an outdoor heat exchanger 13*b* to be defrosted is higher than 0 degrees C. and lower than or equal to 10 degrees C., in terms of saturation temperature. The reducing device 20 has an opening degree at which refrigerant can be injected into the compressor 11 until the discharge superheat reaches about 10 K to 20 K, for example, so as to control the discharge temperature and discharge superheat of the compressor 11, for example.

As illustrated in FIG. 2, the first connection pipes 24*a* and 24*b* are connected to the heat transfer tubes 5*a* upstream of the outdoor heat exchangers 13*a* and 13*b* in the air flow direction. The heat transfer tubes 5*a* of the outdoor heat exchangers 13*a* and 13*b* are arranged in a plurality of columns in the air flow direction and refrigerant sequentially flows toward downstream rows. Thus, refrigerant supplied to the outdoor heat exchanger 13*b* to be defrosted flows from the heat transfer tubes 5*a* upstream in the air flow direction to the downstream side, and parallel flows in which the refrigerant flow direction coincides with the air flow direction are obtained.

As described above, in the outdoor heat exchanger 13 to be defrosted according to Embodiment 4, the refrigerant flow direction can be made coincide with the air flow direction. The parallel flow of refrigerant allows heat transferred to the air in defrosting to be used for defrosting of frost on the downstream fins 5*b*. Thus, the efficiency of defrosting can be increased.

Embodiment 5

In Embodiments 1 to 4, the outdoor heat exchangers 13 are divided into two outdoor heat exchangers 13*a* and 13*b*. However, the present invention is not limited to this example. In a configuration including three or more outdoor heat exchangers, application of the above-described inventive concept allows some of the outdoor heat exchangers 13 to be defrosted with other outdoor heat exchangers 13 continuing a heating operation.

In Embodiments 1 to 4, one outdoor heat exchanger is divided into a plurality of outdoor heat exchangers 13. However, the present invention is not limited to this example. In a configuration including separate outdoor heat exchangers 13 that are connected in parallel, application of the above-described inventive concept allows part of the outdoor heat exchangers 13 to be defrosted and another part of the outdoor heat exchangers 13 to continue a heating operation.

REFERENCE SIGNS LIST

5*a* heat transmission pipe, 5*b* fin, 10 outdoor unit, 11 compressor, 12 cooling/heating switching device, 13, 13*a*, 13*b* outdoor heat exchanger, 14 accumulator, 15*a*, 15*b* second flow rate control device, 15*c* third flow rate control device, 16, 16*a*, 16*b* first solenoid valve, 17, 17*a*, 17*b* second solenoid valve, 18, 20 reducing device, 19, 19*a*, 19*b* third solenoid valve, 21 outdoor fan, 22 discharge pipe, 23 suction pipe, 24, 24*a*, 24*b* first connection pipe, 25, 25*a*, 25*b* second connection pipe, first defrosting pipe, 27 second defrosting pipe, 28 refrigerant-refrigerant heat exchanger, 29 fourth flow rate control device, 30, 30*a*, 30*b* indoor unit, 31, 31*a*, 31*b* indoor heat exchanger, 32, 32*a*, 32*b* first flow rate control device, 40, 41*a*, 41*b* first extension pipe, 50, 51*a*, 51*b* second extension pipe, 60 control device, 70*a*, 70*b* check valve, 71 third defrosting pipe, 100, 101, 102, 103, 104 air-conditioning apparatus.

The invention claimed is:

1. An air-conditioning apparatus comprising:

a refrigerant;

a compressor configured to:

allow a first portion of a defrost refrigerant stream of the refrigerant to be injected into a portion of the compressor located intermediate of a compressor stroke, draw a first combined heating-defrost refrigerant stream of the refrigerant having a first pressure, wherein the first combined heating-defrost refrigerant stream comprises a heating refrigerant stream of the refrigerant and a second portion of the defrost refrigerant stream, compress the first portion of the defrost refrigerant stream and the first combined heating-defrost refrigerant stream, and discharge a second combined heating-defrost refrigerant stream of the refrigerant having a third pressure, wherein the second combined heating-defrost refrigerant stream comprises the first portion of the defrost refrigerant stream injected into the compressor and the first combined heating-defrost refrigerant stream drawn by the compressor;

an indoor heat exchanger to exchange heat between air to be conditioned and the heating refrigerant stream of the refrigerant, wherein the heating refrigerant stream is branched from the second combined heating-defrost refrigerant stream;

a first flow rate control device to adjust and control a flow rate of the heating refrigerant stream of the refrigerant passing through the indoor heat exchanger;

a plurality of outdoor heat exchangers connected in parallel to exchange heat between outdoor air and the refrigerant, the compressor, the indoor, heat exchanger, the first flow rate control device, and the plurality of outdoor heat exchangers being connected by a plurality of pipes to form a main refrigerant circuit in which the refrigerant circulates;

a first defrosting pipe to allow the defrost refrigerant stream branched from the second combined heating-defrost refrigerant stream discharged from the compressor to pass therethrough and flow into at least one of the plurality of outdoor heat exchangers to be defrosted;

a first pressure adjustment device to adjust a pressure of the defrost refrigerant stream passing through the first defrosting pipe to a second pressure higher than the first pressure and lower than the third pressure;

a second defrosting pipe to allow the first portion of the defrost refrigerant stream that has passed through the at least one of the outdoor heat exchangers to be defrosted to pass therethrough to be injected into the compressor;

a second pressure adjustment device to adjust a pressure of the the first portion of the defrost refrigerant stream passing through the second defrosting pipe to an injection pressure;

a controller configured to perform defrosting and heating by causing at least one of the outdoor heat exchangers other than the at least one of the outdoor heat exchangers to be defrosted to serve as an evaporator; and a third pressure adjustment device to adjust a pressure of the second portion of the defrost refrigerant stream that has flowed out of the at least one of the outdoor heat exchangers to be defrosted to have a pressure corresponding correspond to a saturation temperature of higher than 0 degrees C. and lower than or equal to 10 degrees C. and cause the second portion of the defrost refrigerant stream to flow into upstream of the outdoor heat exchanger serving as the evaporator, in the main refrigerant circuit, wherein the second defrosting pipe branches off at a position between the third pressure adjustment device and the at least one of the outdoor heat exchanger to allow the first portion of the defrost refrigerant stream used for defrosting to be injected into the compressor, the position in which the second defrosting pipe branches off is downstream of the at least one of the outdoor heat exchanger to be defrosted and upstream of the third pressure adjustment device in a refrigerant flow direction during defrosting.

2. The air-conditioning apparatus of claim 1, further comprising a refrigerant-refrigerant heat exchanger to exchange heat between the heating refrigerant stream flowing in the main refrigerant circuit to flow into the at least one of the outdoor heat exchangers serving as the evaporator and the first portion of the defrost refrigerant stream flowing in the second defrosting pipe.

3. The air-conditioning apparatus of claim 1, further comprising a fourth pressure adjustment device to adjust a pressure of a first portion of a second heating refrigerant stream of the refrigerant flowing in the main refrigerant circuit and cause the first portion of the second heating refrigerant stream to flow into the second defrosting pipe.

4. The air-conditioning apparatus of claim 1, wherein the outdoor heat exchanger includes a plurality of heat transfer tubes to allow the refrigerant to pass therethrough, the plurality of heat transfer tubes arranged in a plurality of levels extending perpendicularly to direction of passage of the outdoor air and in a plurality of columns extending in parallel with the direction of passage of the outdoor air, and a plurality of fins spaced from one another so that the outdoor air passes therethrough in the direction of passage of the outdoor air, a first pipe of the plurality of pipes is connected to the heat transfer tubes in a first column upstream in the direction of passage of the outdoor air and is connected to the first defrosting pipe, and a second pipe of the plurality of pipes is connected to the heat transfer tubes in a second column downstream in the direction of passage of the outdoor air and is connected to the second defrosting pipe.

5. The air-conditioning apparatus of claim 1, wherein the controller is configured to control a discharge temperature or a discharge superheat of the second combined heating-defrost refrigerant stream discharged from the compressor by adjustment of the pressure by the second pressure adjustment device.

6. The air-conditioning apparatus of claim 1, further comprising an outdoor-air temperature detector to detect an outdoor-air temperature of the outdoor air outside a space to be air-conditioned, wherein the first pressure adjustment device is configured to perform a flow rate control based on the outdoor-air temperature.

7. The air-conditioning apparatus of claim 1, further comprising an outdoor-air temperature detector to detect an outdoor-air temperature of the outdoor air outside a space to be air-conditioned, wherein the controller is configured to change a criterion for determining whether to start a defrosting operation, based on the outdoor-air temperature.

8. The air-conditioning apparatus of claim 1, further comprising an outdoor-air temperature detector to detect an outdoor-air temperature of the outdoor air outside a space to be air-conditioned, wherein the controller is configured to select, based on the outdoor-air temperature, from a heating-and-defrosting operation mode in which the at least one of the outdoor heat exchangers to be defrosted is selected and defrosted and the at least one outdoor heat exchangers serving as an the evaporator continues heating, and a heating-stop defrosting operation mode in which all the outdoor heat exchangers are defrosted.

9. The air-conditioning apparatus of claim 1, further comprising an outdoor-air temperature detector to detect an outdoor-air temperature of the outdoor air outside a space to be air-conditioned, and an outdoor fan to blow the outdoor air to the plurality of outdoor heat exchangers, wherein the controller is configured to change, based on the outdoor-air temperature, output power of the outdoor fan when defrosting the at least one of the outdoor heat exchangers to be defrosted.

10. The air-conditioning apparatus of claim 1, wherein the controller is configured to defrost each of the plurality of outdoor heat exchangers at least once in a defrosting operation mode.

* * * * *